US009270056B2

(12) United States Patent
Higuchi et al.

(10) Patent No.: US 9,270,056 B2
(45) Date of Patent: Feb. 23, 2016

(54) CONNECTOR

(71) Applicant: JAPAN AVIATION ELECTRONICS INDUSTRY, LIMITED, Tokyo (JP)

(72) Inventors: Masao Higuchi, Tokyo (JP); Tadashi Ishiwa, Tokyo (JP); Masayoshi Nitta, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/149,038

(22) Filed: Jan. 7, 2014

(65) Prior Publication Data

US 2015/0056859 A1 Feb. 26, 2015

(30) Foreign Application Priority Data

Aug. 23, 2013 (JP) ..... 2013-173348

(51) Int. Cl.

| | |
|---|---|
| ***H01R 9/03*** | (2006.01) |
| ***H01R 13/648*** | (2006.01) |
| ***H01R 13/6473*** | (2011.01) |
| ***H01R 24/64*** | (2011.01) |
| *H01R 13/52* | (2006.01) |
| *H01R 13/6581* | (2011.01) |
| *H01R 13/6582* | (2011.01) |

(52) U.S. Cl.

CPC ..... *H01R 13/648* (2013.01); *H01R 13/6473* (2013.01); *H01R 24/64* (2013.01); *H01R 13/5208* (2013.01); *H01R 13/5219* (2013.01); *H01R 13/6581* (2013.01); *H01R 13/6582* (2013.01)

(58) Field of Classification Search

CPC ..... H01R 13/648
USPC ..... 439/607.41, 98, 108, 410
See application file for complete search history.

(56) References Cited

U.S. PATENT DOCUMENTS

| | | | | |
|---|---|---|---|---|
| 5,620,340 | A * | 4/1997 | Andrews | 439/607.1 |
| 6,036,545 | A | 3/2000 | Caviness et al. | |
| 6,948,977 | B1 | 9/2005 | Behrent | |
| 7,658,644 | B2 * | 2/2010 | Ahn | 439/587 |

(Continued)

FOREIGN PATENT DOCUMENTS

| | | |
|---|---|---|
| JP | H04-345778 | 12/1992 |
| JP | 2004-047276 | 2/2004 |

OTHER PUBLICATIONS

Search report from E.P.O., mail date is Jan. 19, 2015.

*Primary Examiner* — Abdullah Riyami
*Assistant Examiner* — Nelson R Burgos-Guntin
(74) *Attorney, Agent, or Firm* — Greenblum & Bernstein, P.L.C.

(57) ABSTRACT

In a connector that includes a board connector mounted on a board and a cable connector attached to ends of both a shielded cable and a non-shielded cable and connected to the board connector, the cable connector includes contacts connected respectively to the core wires of the shielded cable and the non-shielded cable and a shield shell that surrounds only the contacts connected to the core wires of the shielded cable, and the board connector includes board contacts connected respectively to the contacts of the cable connector and a shield shell that surrounds only the board contacts connected to the contacts surrounded by the shield shell of the cable connector. The connector properly shields the contacts connected to the core wires of the shielded cable in both of the mutually connected connectors and makes it easy to perform impedance matching.

12 Claims, 28 Drawing Sheets

(56) References Cited

U.S. PATENT DOCUMENTS 8,727,639 B2 * 5/2014 Matsui et al. ..... 385/88
2004/0166719 A1 8/2004 Bernat et al.
2009/0318023 A1 12/2009 Block et al.

* cited by examiner

CONNECTOR

BACKGROUND OF THE INVENTION

1. Field of the Invention

The present invention relates to a connector for connecting both a shielded cable and a non-shielded cable.

2. Description of the Related Art

FIGS. 1A and 1B show the structure of an example of the conventional connector of the same type disclosed in Japanese Patent Application Laid Open No. H04-345778 (issued on Dec. 1, 1992). FIG. 1A shows a terminal housing with a shielded cable and a non-shielded cable attached. FIG. 1B shows a connector housing into which the terminal housing is inserted.

A terminal housing 1 includes a shielded terminal 3 for a shielded cable 2 and a non-shielded terminal 5 for a non-shielded cable 4. The shielded terminal 3 is formed by a core-wire terminal 3*a* covered by an external conductor terminal 3*c*, with an insulating material 3*b* placed between them. The core-wire terminal 3*a* has a contact part 3*d*, and the base part is secured to and electrically connected to a core wire 2*a* of the shielded cable 2. The external conductor terminal 3*c* has a contact part 3*e* formed at its end, and the base part is secured to and electrically connected to an external conductor 2*b* of the shielded cable 2.

The non-shielded terminal 5 to which the non-shielded cable 4 is attached is similar to the core-wire terminal 3*a* for the shielded terminal 3, and has a contact part 5*a*.

The shielded terminal 3 and the non-shielded terminal 5 are respectively inserted into a shielded-terminal insertion hole 6 and a non-shielded-terminal insertion hole 7 in the terminal housing 1. The terminal housing 1 has an engaging piece 8 at the top thereof, and the engaging piece 8 has an engaging projection part 8*a*.

A connector housing 11 includes a terminal mounting hole 12 and lead-out terminals 13, 14, and 15. The lead-out terminals 13 and 15 have a bar shape and project into the terminal mounting hole 12 from the back of the connector housing 11. The lead-out terminal 14 has a plate shape and is disposed along the inner face of back of the terminal mounting hole 12. The lead-out terminal 14 has a hole 14*a* which lets the lead-out terminal 13 pass through it without being in contact with it, and the back face is connected to a lead 14*b*. The connector housing 11 has an engaging hole 16 at the top thereof, and an engaging indentation 16*a* is formed in the engaging hole 16.

The terminal housing 1 is inserted into the terminal mounting hole 12 of the connector housing 11. The engaging piece 8 of the terminal housing 1 is inserted into the engaging hole 16 of the connector housing 11, and the engaging projection part 8*a* of the engaging piece 8 is engaged with the engaging indentation 16*a* in the engaging hole 16. The lead-out terminal 13 of the connector housing 11 comes into contact with the contact part 3*d* of the core-wire terminal 3*a* in the terminal housing 1, and the lead-out terminal 14 is held in contact with the contact part 3*e* of the external conductor terminal 3*c*. The lead-out terminal 15 is held in contact with the contact part 5*a* of the non-shielded terminal 5.

The connector illustrated in FIGS. 1A and 1B serves both the shielded cable 2 and the non-shielded cable 4 as described above and allows both the shielded cable 2 and the non-shielded cable 4 to be attached or detached as an integrated unit.

In the terminal housing 1, the core-wire terminal 3*a* connected with the core wire 2*a* of the shielded cable 2 is surrounded and shielded by the external conductor terminal 3*c*. While the terminal housing 1 is inserted into the connector housing 11, a part projecting into the terminal mounting hole 12, of the lead-out terminal 13 of the connector housing 11 in contact with the core-wire terminal 3*a*, is also surrounded by the external conductor terminal 3*c* and is therefore shielded. However, a part of the lead-out terminal 13, including an L-shaped part projecting from the back of the connector housing 11, is not shielded at all, causing impedance mismatching. If a high-speed (high-frequency) signal is transmitted, deterioration of the transmission characteristics is unavoidable.

SUMMARY OF THE INVENTION

It is an object of the present invention to provide a connector that connects both a shielded cable and a non-shielded cable, the connector having two types of mutually connected connectors that respectively shield the contacts connected to the core wire of the shielded cable, making it easy to perform impedance matching and consequently providing excellent transmission characteristics.

A connector according to the present invention includes a board connector mounted on a board and a cable connector attached to ends of both a shielded cable and a non-shielded cable and connected to the board connector. The cable connector includes contacts connected respectively to the core wires of the shielded cable and the non-shielded cable and a shield shell surrounding only the contacts connected to the core wires of the shielded cable. The board connector includes board contacts connected respectively to the contacts of the cable connector and a shield shell surrounding only the board contacts connected to the contacts surrounded by the shield shell.

In the connector according to the present invention, the contacts of the cable connector connected to the core wires of the shielded cable are surrounded and shielded by the shield shell, and the board contacts of the board connector connected to the contacts surrounded by the shield shell of the cable connector are surrounded and shielded by the shield shell of the board connector. Therefore, impedance matching can be performed easily, excellent transmission characteristics can be obtained, and a high-speed signal can be transmitted with low loss.

DETAILED DESCRIPTION OF THE PREFERRED EMBODIMENTS

Embodiments of the present invention will be described next.

First Embodiment

A connector for connecting both a shielded cable and a non-shielded cable in this embodiment includes a cable connector attached to ends of both the shielded cable and the non-shielded cable and a board connector mounted on a board.

Figure 1A:
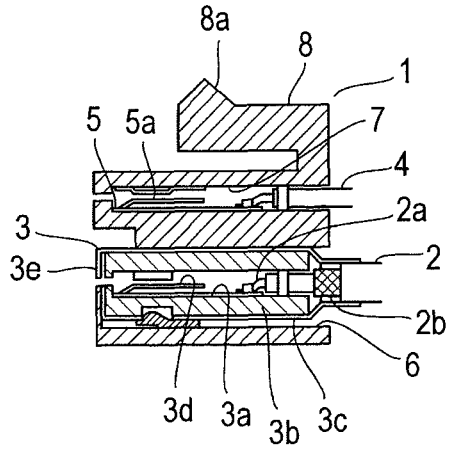
FIG. 1A PRIOR ART
FIG. 1A is a sectional view showing the structure of one of two conventional connectors to be mutually connected.
Figure 1B:
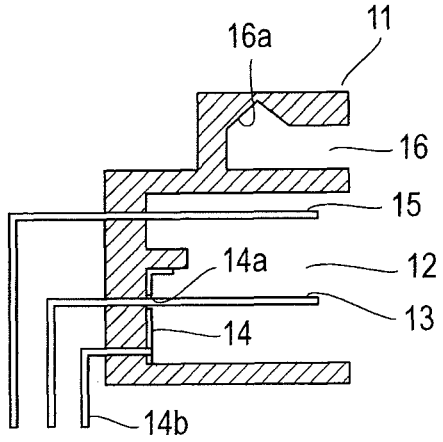
FIG. 1B PRIOR ART
FIG. 1B is a sectional view showing the structure of the other of the two conventional connectors to be mutually connected.
Figure 2C:
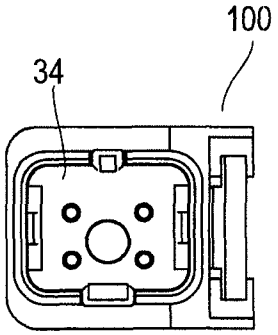
FIG. 2C is a rear view of the cable connector shown in FIG. 2A.
Figure 2B:
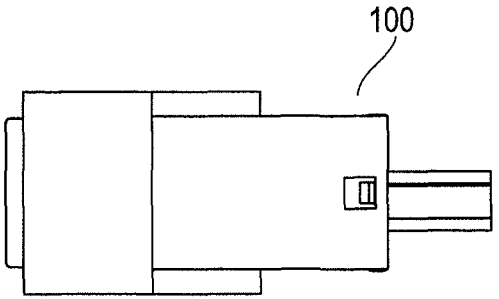
FIG. 2B is a side view of the cable connector shown in FIG. 2A.
Figure 2A:
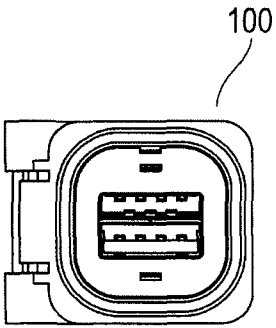
FIG. 2A is a front view of a cable connector of a connector according to a first embodiment of the present invention.
Figure 2E:
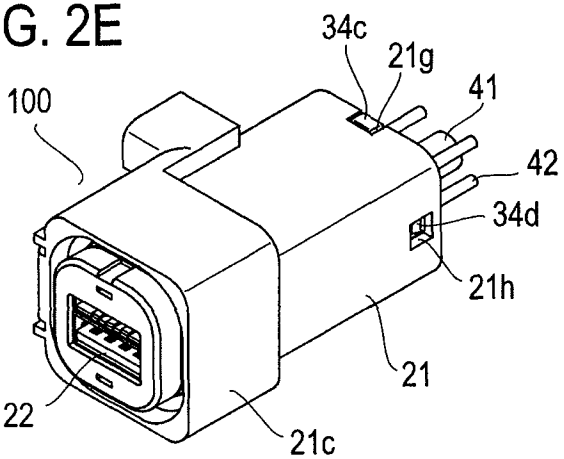
FIG. 2E is a perspective view of the cable connector shown in FIG. 2A.
Figure 2D:
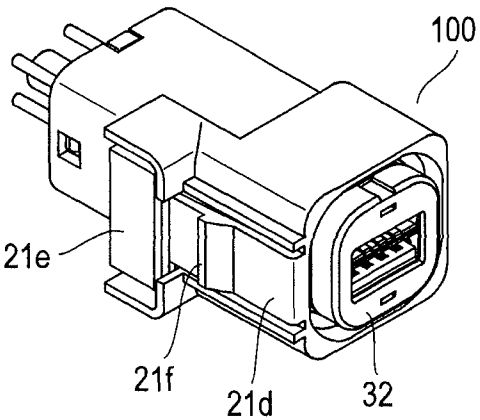
FIG. 2D is a perspective view of the cable connector shown in FIG. 2A.
Figure 3:
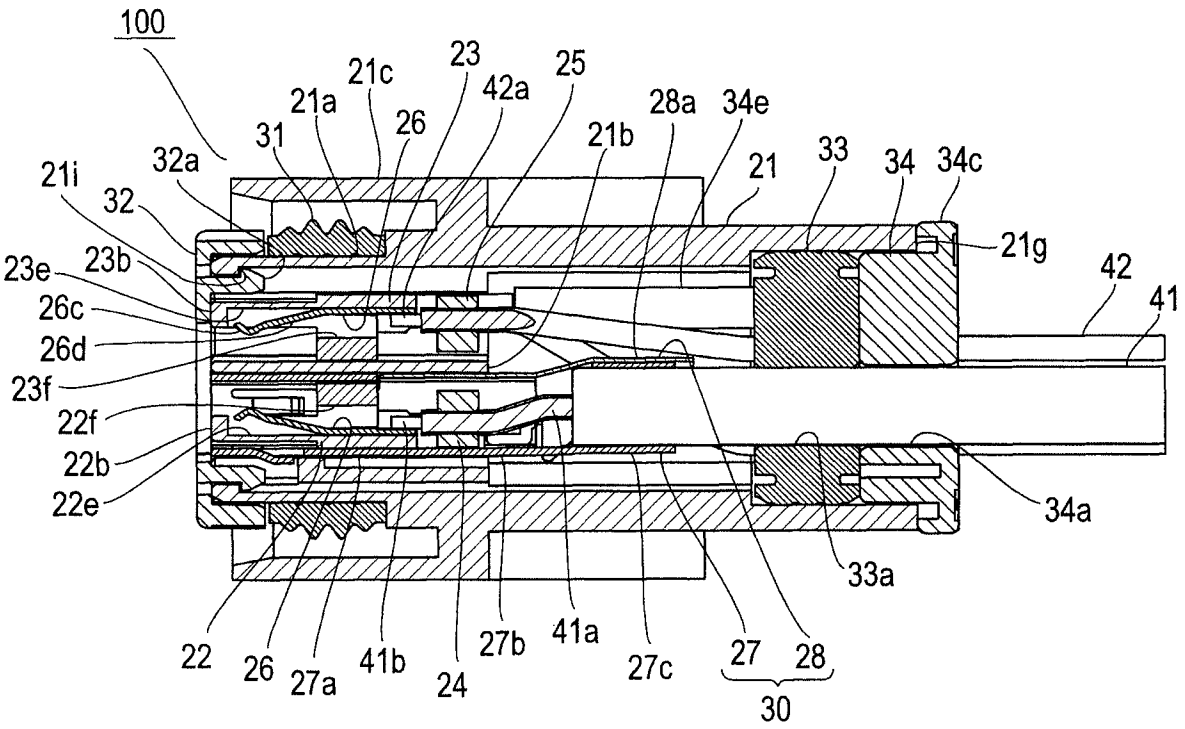
FIG. 3 is a sectional view of the cable connector shown in FIG. 2A.
Figure 4:
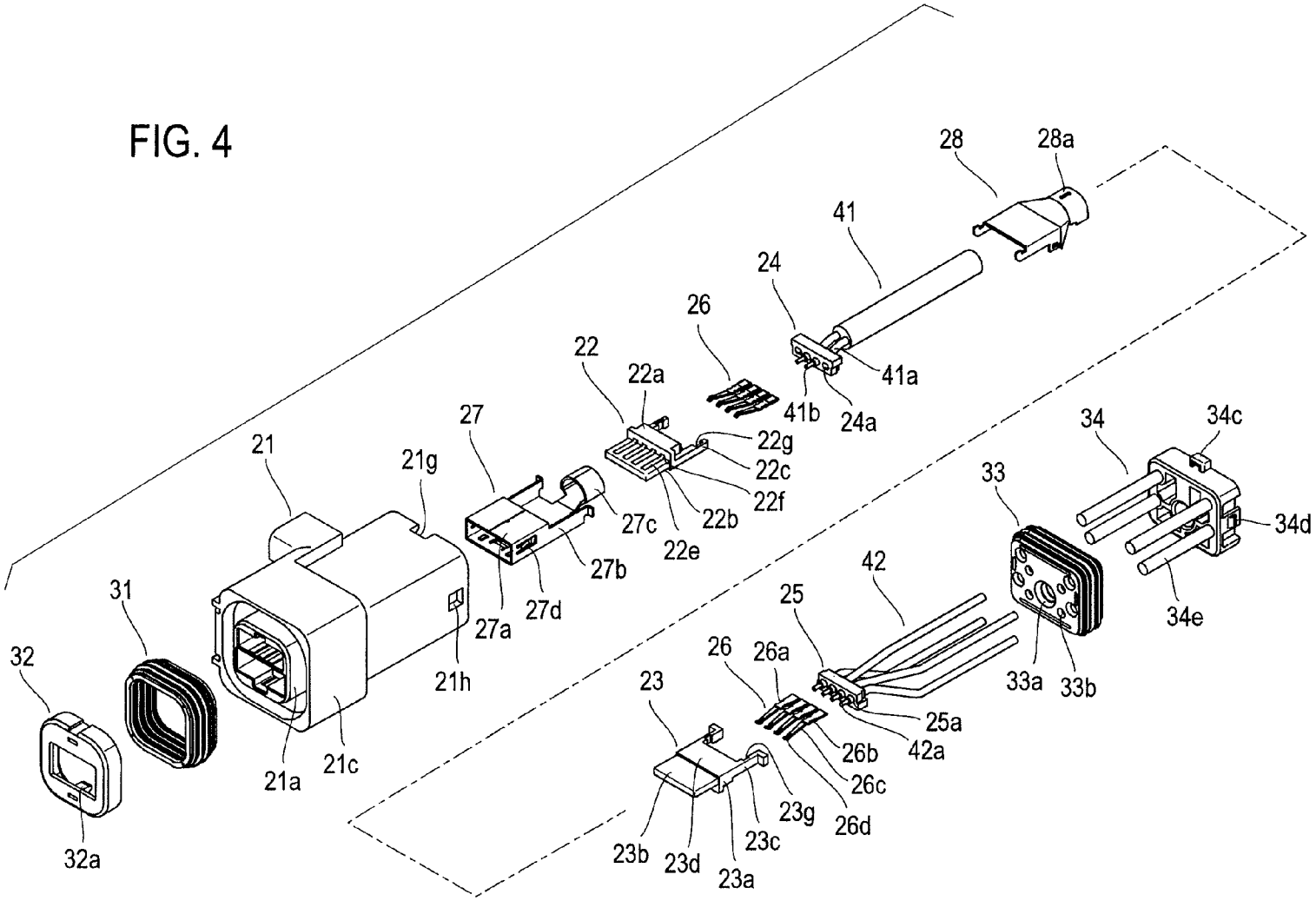
FIG. 4 is an exploded perspective view of the cable connector shown in FIG. 2A, viewed from the front.
Figure 5:
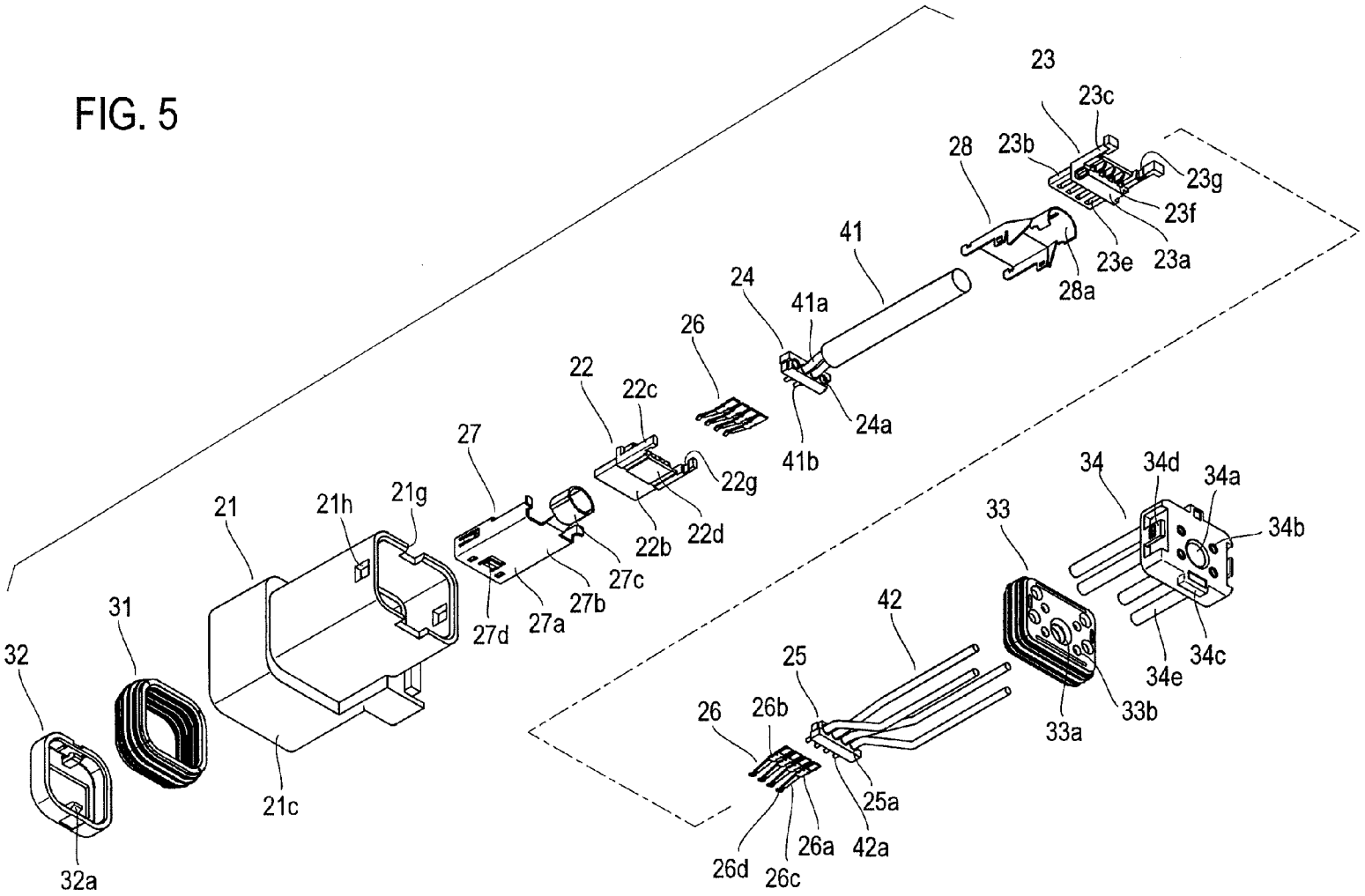
FIG. 5 is an exploded perspective view of the cable connector shown in FIG. 2A, viewed from the back.
Figure 6A:
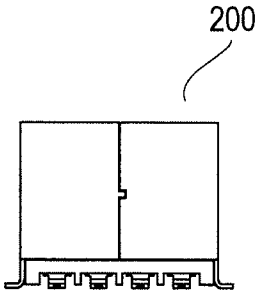
FIG. 6A is a front view of a board connector of the connector according to the first embodiment of the present invention.
Figure 6B:
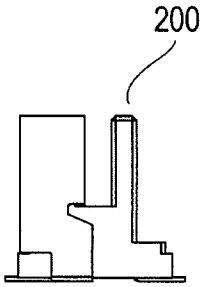
FIG. 6B is a side view of the board connector shown in FIG. 6A.
Figure 6C:
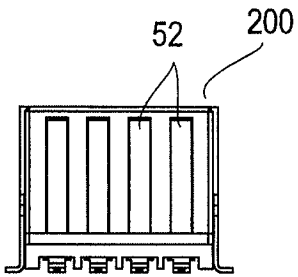
FIG. 6C is a rear view of the board connector shown in FIG. 6A.
Figure 6D:
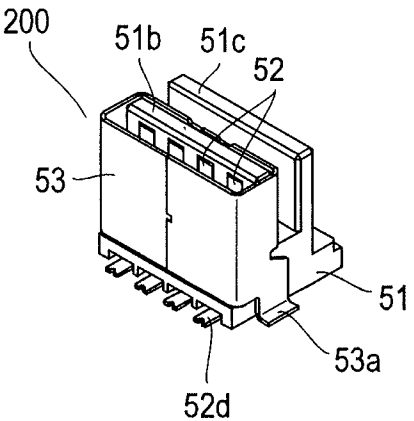
FIG. 6D is a perspective view of the board connector shown in FIG. 6A.
Figure 6E:
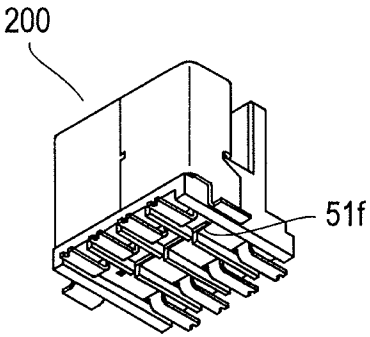
FIG. 6E is a perspective view of the board connector shown in FIG. 6A.
Figure 6F:
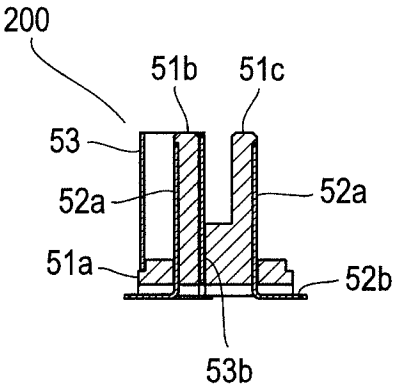
FIG. 6F is a sectional view of the board connector shown in FIG. 6A.

FIGS. 2A to 2E show the appearance of a cable connector 100, and FIG. 3 is a sectional view of the structure. FIGS. 4 and 5 are exploded views of the cable connector 100. As shown in FIGS. 4 and 5, the cable connector 100 includes an outer housing 21, inner housings 22 and 23, cable holders 24 and 25, contacts 26, a shell 27, a cover shell 28, a rubber seal 31, a front cap 32, a grommet 33, and a retainer 34. In FIGS. 4 and 5, reference numeral 41 denotes a shielded cable, and reference numeral 42 denotes a non-shielded cable (discrete wire).

The inner housings 22 and 23 hold the contacts 26 in line and are made of resin.

The inner housing 22 includes a base part 22*a*, a tongue piece 22*b* projecting from the base part 22*a* toward the front, a pair of arm parts 22*c* projecting from both ends in the width direction of the base part 22*a* toward the back, and a plate-like part 22*d* which connects the arm parts 22*c* on the side of the base part 22*a*. In the tongue piece 22*b*, four grooves 22*e* parallel to the projecting direction are formed in this embodiment. These grooves 22*e* extend respectively through holes 22*f* formed in the base part 22*a* toward the plate-like part 22*d*. The arm parts 22*c* each have an indentation 22*g* on their inner faces that face each other, near their ends.

The inner housing 23 has the same structure as the inner housing 22, including a base part 23*a*, a tongue piece 23*b*, a pair of arm parts 23*c*, and a plate-like part 23*d* and has four grooves 23*e*, four holes 23*f*, and a pair of indentations 23*g*.

The contacts 26 are made of strip-shaped metal plates. A press fitting part 26*a* in the middle part in the longitudinal direction of each contact 26 has projections 26*b* to be press-fitted on both sides in the width direction. The front side of the press fitting part 26*a* is bent and raised to make a movable section 26*c*, and a contact portion 26*d* is folded back into a circular shape at the tip of the movable section 26*c*.

Four contacts 26 are attached to each of the inner housings 22 and 23. The press fitting parts 26*a* of the contacts 26 are press-fitted respectively into the holes 22*f* and 23*f* of the inner housings 22 and 23, and the contacts 26 are respectively disposed in the grooves 22*e* and 23*e*.

Core wires of the shielded cable 41 are connected to the back ends of the contacts 26 press-fitted into the inner housing 22, and core wires of the non-shielded cables 42 are connected to the back ends of the contacts 26 press-fit into the inner housing 23.

In the grommet 33 and the retainer 34 disposed at the back end of the cable connector 100, holes 33*a* and 34*a* for inserting the shielded cable 41 and holes 33*b* and 34*b* for inserting the non-shielded cable 42 are formed, respectively. Four holes 33*b* and four holes 34*b* are formed for inserting the non-shielded cables 42. In this embodiment, one shielded cable 41 and four non-shielded cables 42 are attached.

The shielded cable 41 is passed through the hole 34*a* of the retainer 34 and the hole 33*a* of the grommet 33. The shielded cable 41 in this embodiment is a two-core cable having two signal wires 41*a*. These signal wires 41*a* are respectively passed through holes 24*a* arranged in the resin cable holder 24, having a block shape, and are positioned accordingly. Four holes 24*a* are formed in this embodiment, and the signal wires 41*a* are passed through two of the holes 24*a* disposed in inner positions.

The cable holder 24 holding the signal wires 41*a* is press-fitted between the pair of arm parts 22*c* of the inner housing 22 and is positioned and secured with its ends fitted into the indentations 22*g* of the pair of atm parts 22*c*. The core wires 41*b* of the two signal wires 41*a* are respectively connected by soldering them to the back ends of contacts 26 held in line by the inner housing 22.

A shell 27 is attached to the inner housing 22. The shell 27 is formed by bending a metal plate. The front half 27*a* has a rectangular tube shape surrounding the inner housing 22. The back half 27*b* has a rectangular tube shape with an open top. A crimping part 27*c* projecting from the back half 27*b* is formed at the back of the back half 27*b*.

The crimping part 27*c* of the shell 27 is not shown in detail in FIG. 3 but is crimped around the shield of the core wires of the shielded cable 41 with its jacket removed. A cover shell 28 is attached to the back half 27*b* of the shell 27.

The cover shell 28 is formed by bending a metal plate and covers the top of the back half 27*b* of the shell 27. The cover shell 28 has a crimping part 28*a* at the back, and the crimping part 28*a* is crimped around the crimping part 27*c* of the shell 27.

In this embodiment, the shell 27 and the cover shell 28 form a shield shell 30. The signal wires 41*a* drawn from the shielded cable 41 and the contacts 26 held in the inner housing 22 are surrounded at their full lengths by the shield shell 30 formed of the shell 27 and the cover shell 28, as shown in FIG. 3.

The four non-shielded cables 42 are passed through the holes 34*b* in the retainer 34 and the holes 33*b* in the grommet 33. The four non-shielded cables 42 are inserted into respective holes 25*a* in the cable holder 25, which has the same structure as the cable holder 24, and are positioned accordingly.

The cable holder 25 holding the four non-shielded cables 42 is press-fitted between the pair of arm parts 23*c* of the inner housing 23, and its ends are inserted into the indentations 23*g* in the pair of arm parts 23*c* to position the cable holder 25. The core wires 42*a* of the four non-shielded cables 42 are connected by soldering them to the back ends of the contacts 26 held in line by the inner housing 23.

The inner housing 23 and the inner housing 22 to which the shield shell 30 is attached are inserted into the outer housing 21 and are positioned in an insertion joint 21*a* in the front end of the outer housing 21.

The outer housing 21 forms the external shape of the cable connector 100, is made of resin, and has a rectangular tube shape with rounded corners and edges. In the front insertion joint 21*a* in the front end of the outer housing 21, spaces for holding the inner housing 23 and the inner housing 22 with the shield shell 30 attached thereto are formed by a partition wall 21*b*. The front ends of the inner housings 22 and 23 are adjacent to each other in the front end of the insertion joint 21*a*.

A tubular part 21*c* is disposed to surround the insertion joint 21*a* from the outside, leaving a given space around the insertion joint 21*a*. A fixed spring piece 21*d* is formed on the outer face of the tubular part 21*c*, extending from the front end toward the back end of the outer housing 21. The back end of the fixed spring piece 21*d* is a free end, and an operating element 21*e* that can be pressed with a finger is formed on the free end. A projection 21*f* is formed on the outer surface of the fixed spring piece 21*d*.

The grommet 33 and the retainer 34 are pressed into the back end of the outer housing 21 in that order. The grommet 33 is a waterproofing member made of rubber, and the grommet 33 closes off the back end of the outer housing 21.

The retainer 34 is disposed on the outside of the grommet 33. A pair of projections 34*c* formed in opposing positions on the periphery of the retainer 34 are fitted into a pair of notches 21*g* formed in the back end of the outer housing 21, and a pair of fixed spring pieces 34*d* formed in opposing positions on the periphery of the retainer 34 in a direction orthogonal to the direction in which the pair of projections 34*c* are facing are caught by a pair of windows 21*h* formed in the outer housing 21. In this way, the retainer 34 is secured to the back end of the outer housing 21. Four rod-shaped pieces 34*e* projecting from the inner face of the retainer 34 hold the inner housings 22 and 23 by pressing their ends against the back end faces of the inner housings 22 and 23.

The rubber seal 31 is attached around the insertion joint 21*a* of the outer housing 21. The rubber seal 31 is a waterproofing member and is held in the space between the insertion joint 21*a* and the tubular part 21*c* surrounding the insertion joint 21*a*. The front cap 32 is mounted to the front end of the insertion joint 21*a* to prevent the rubber seal 31 from falling out. A pair of fixed spring pieces 32*a* are provided on the inner face of the front cap 32. The fixed spring pieces 32*a* are hooked by stage parts 21*i* in the front end of the insertion joint 21*a* to secure the front cap 32 to the outer housing 21. The front cap 32 and the retainer 34 are made of resin.

The structure of the board connector connected to the cable connector 100 structured as described above will be described next.

Figure 7B:
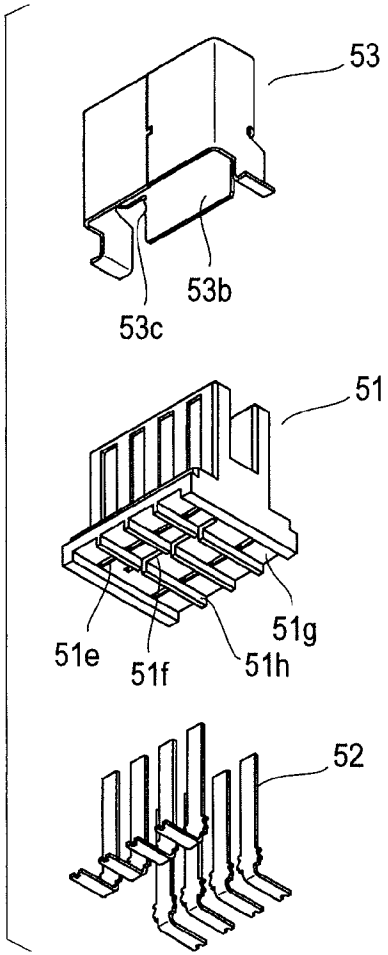
FIG. 7B is an exploded perspective view of the board connector shown in FIG. 6A, viewed obliquely from below.
Figure 7A:
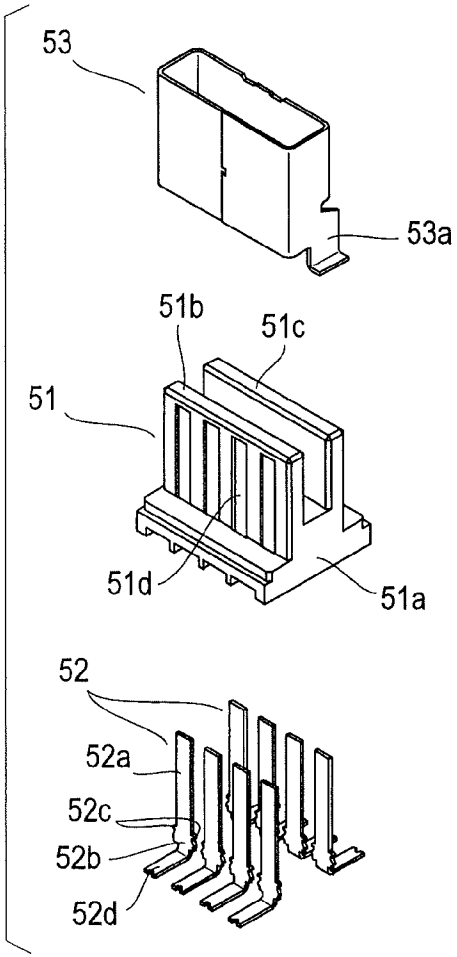
FIG. 7A is an exploded perspective view of the board connector shown in FIG. 6A, viewed obliquely from above.

FIGS. 6A to 6F show the appearance of a board connector 200 and sectional views of the structure. FIGS. 7A and 7B are exploded views of the board connector 200. The board connector 200 includes a body 51, board contacts 52, and a shield shell 53.

The body 51 is made of resin and holds the board contacts 52 in line. The body 51 includes a base 51*a* and a pair of vertical plates 51*b* and 51*c* projecting from the base 51*a*. The outer faces of the pair of vertical plates 51*b* and 51*c* have grooves 51*d* formed in a direction parallel to the direction in which the vertical plates 51*b* and 51*c* project. The vertical plates 51*b* and 51*c* each have four grooves 51*d*.

Slits 51*e* are formed in the base 51*a* in line with the grooves 51*d*. The slits 51*e* have the same cross-sectional shape as the grooves 51*d*. A slit 51*f* is also formed in the base 51*a* on the extension of the inner face of the vertical plate 51*b*.

A recessed part 51*g* is formed in the lower face of the base 51*a*. Walls 51*h* are formed in the recessed part 51*g* and are disposed between adjacent slits 51*e* in the longitudinal direction of the slits 51*e*.

Each board contact 52 is a strip-shaped metal plate bent into an L shape. The base of a vertical part 52*a*, which forms one side of the L shape, is a press-fitting part 52*b*. The press-fitting part 52*b* has projections 52*c* to be press-fitted, projecting from both sides in the width direction.

The board contacts 52 are attached to the body 51 by press-fitting the press-fitting parts 52*b* into the slits 51*e* of the body 51, and the vertical parts 52*a* are disposed in the grooves 51*d* in the vertical plates 51*b* and 51 *c*. A total of eight board contacts 52 are attached to the body 51. The horizontal parts 52*d*, which form the other side of the L shape, of the board contacts 52 arranged on the vertical plates 51*b* and 51 *c* are disposed outward in the recessed part 51*g* of the base 51*a* with their tips projecting from the base 51*a*.

The shield shell 53 is formed by bending a metal plate and has a rectangular tube shape surrounding the vertical plate 51*b* of the body 51. A pair of foots 53*a* project from the opposing short sides at one end of the shield shell 53, and the ends of the foots 53*a* are bent outward. One long side at the same end of the shield shell 53 is a press-fitting part 53*b* to be press-fitted into the slit 51*f* in the body 51. The press-fitting part 53*b* has a width corresponding to the length of the slit 51*f* and also has projections 53*c* to be press-fitted, projecting from both sides in the width direction.

The press-fitting part 53*b* is press-fitted into the slit 51*f* of the body 51 to attach the shield shell 53 to the body 51 in such a manner that the vertical plate 51*b* is surrounded thereby. A face of the shield shell 53 facing the board contacts 52 arranged on the vertical plate 51*b* is separated from the board contacts 52. A given space is left between the shield shell 53 and the board contacts 52.

Figure 8A:
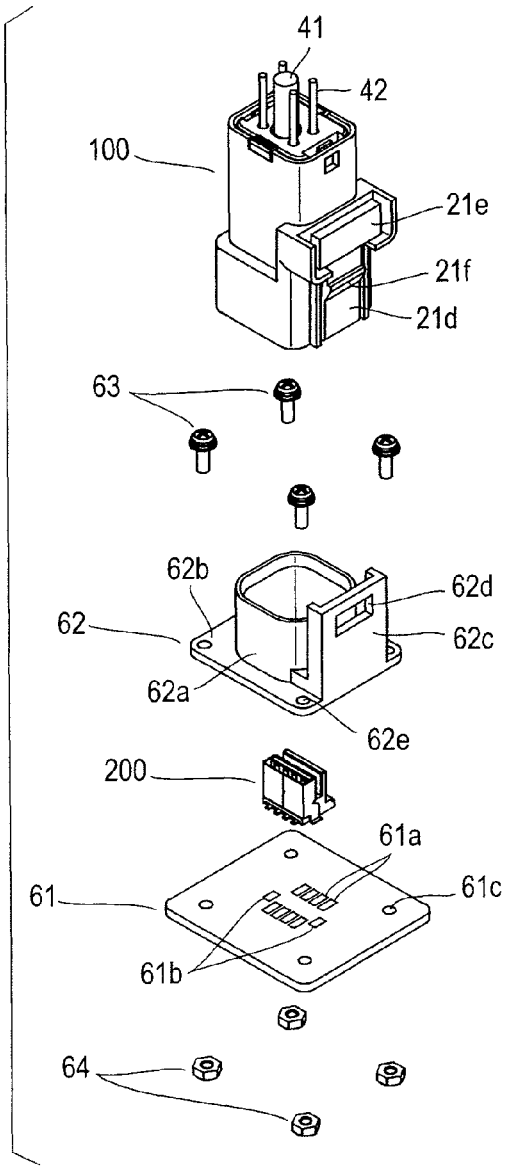
FIG. 8A is an exploded perspective view of the structure of the connector according to the first embodiment of the present invention, viewed obliquely from above.
Figure 8B:
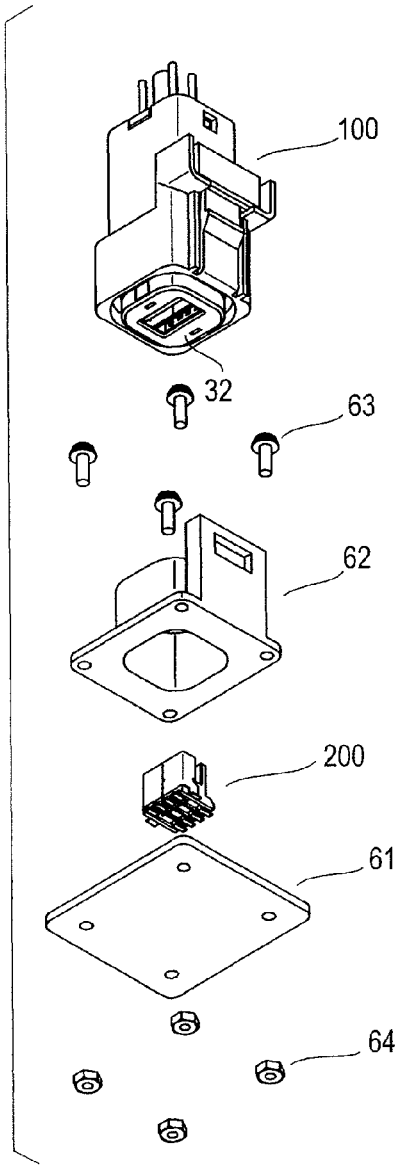
FIG. 8B is an exploded perspective view of the structure of the connector according to the first embodiment of the present invention, viewed obliquely from below.

FIGS. 8A and 8B show the cable connector 100, the board connector 200, a board 61 on which the board connector 200 is mounted, and a housing 62 which is mounted on the board 61.

The board 61 has eight electrode patterns 61*a* to which the board contacts 52 of the board connector 200 are soldered respectively and two ground electrode patterns 61*b* to which the pair of foots 53*a* of the shield shell 53 of the board connector 200 are soldered respectively. The board connector 200 is surface-mounted onto the board 61 by reflow soldering.

The housing 62 is made of resin and includes a tubular part 62*a*, a rectangular flange 62*b* disposed on one end of the tubular part 62*a*, and a side wall part 62*c* provided upright on one side of the rectangular flange 62*b* in parallel with the tubular part 62*a*. The tubular part 62*a* has a rectangular tube shape with corners rounded to match the external shape of the insertion joint 21*a* of the cable connector 100. In the upper part of the side wall part 62*c*, a rectangular window 62*d* for catching the projection 21*f* on the cable connector 100 is formed.

The housing 62 is mounted on the board 61 to surround the board connector 200 mounted on the board 61. The housing 62 is secured with screws 63 and nuts 64. The flange 62*b* of the housing 62 and the board 61 have four holes 62*e* and four holes 61*c*, respectively. The housing 62 is secured to the board 61 by inserting the four screws 63 into the holes 62*e* and 61*c* and tightening the nuts 64.

Figure 9B:
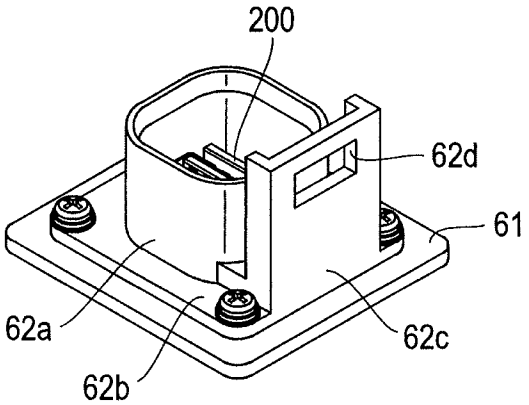
FIG. 9B is a perspective view of the board shown in FIG. 8A with the board connector and the housing mounted on it.
Figure 9A:
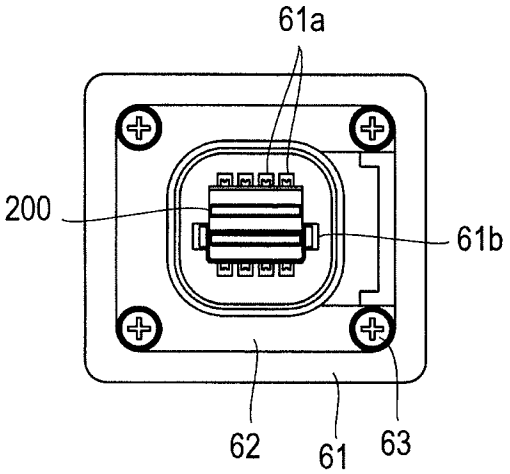
FIG. 9A is a plan view of a board shown in FIG. 8A with a board connector and a housing mounted on it.

FIGS. 9A and 9B show the board 61 with the board connector 200 and the housing 62 mounted on it. The board connector 200 is placed at the center of the tubular part 62*a* of the housing 62.

Figure 10B:
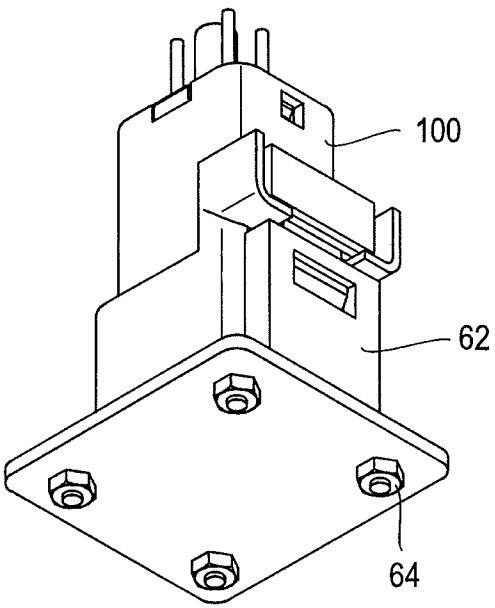
FIG. 10B is a perspective view of the connected state of the connector according to the first embodiment of the present invention, viewed obliquely from below.
Figure 10A:
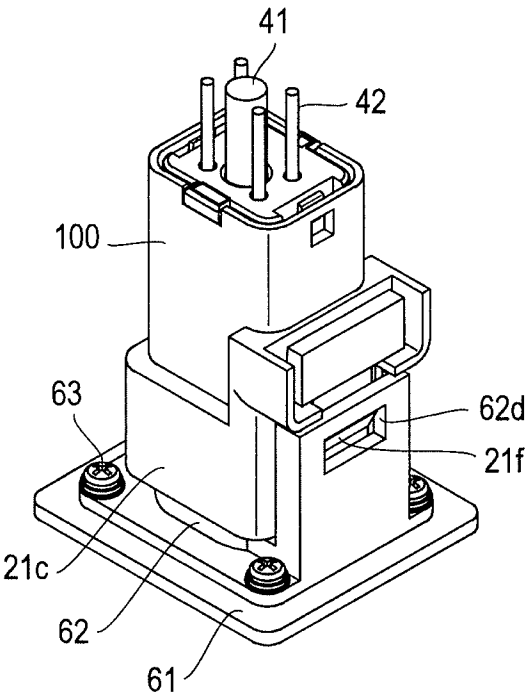
FIG. 10A is a perspective view of a connected state of the connector according to the first embodiment of the present invention, viewed obliquely from above.
Figure 11:
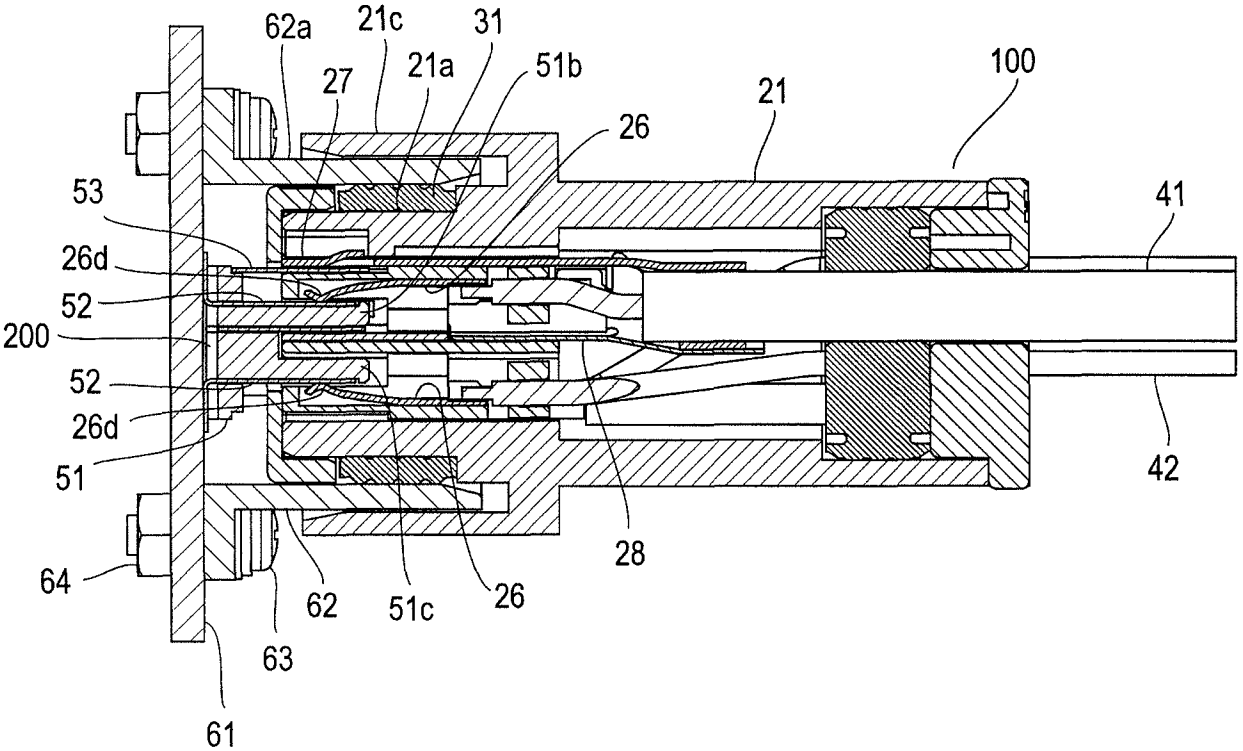
FIG. 11 is a sectional view of the connected state of the connector shown in FIG. 10A.

FIGS. 10A and 10B show the board connector 200 mounted on the board 61 with the cable connector 100 connected thereto. FIG. 11 shows a sectional view of the connected state.

The insertion joint 21*a* of the cable connector 100 is inserted into and coupled to the tubular part 62*a* of the housing 62. The projection 21*f* of the cable connector 100 is caught by the window 62*d* of the housing 62. The housing 62 guides the cable connector 100 toward the board connector 200 and also prevents the cable connector 100 from falling. The cable connector 100 can be uncoupled by pressing the operating element 21*e* of the cable connector 100 with a finger to release the projection 21*f*, and then the cable connector 100 can be pulled out.

When the cable connector 100 is connected to the board connector 200, the vertical plates 51*b* and 51*c* of the board connector 200 are inserted into the insertion joint 21*a* of the cable connector 100. The contact portions 26*d* of the eight contacts 26 of the cable connector 100 come into contact with the board contacts 52 arranged on the vertical plates 51*b* and 51*c*, respectively, and the eight contacts 26 of the cable connector 100 and the eight board contacts 52 of the board connector 200 are connected. The contacts 26 surrounded by the shield shell 30 of the cable connector 100 are connected to the board contacts 52 surrounded by the shield shell 53 of the board connector 200. The shield shell 53 of the board connector 200 is also inserted into the insertion joint 21*a*. The shield shell 53 and the shield shell 30 of the cable connector 100 are electrically connected to each other by a contact piece 27*d* formed by cutting and raising a part of one shell 27 constituting the shield shell 30, held in contact with the shield shell 53.

Figure 12:
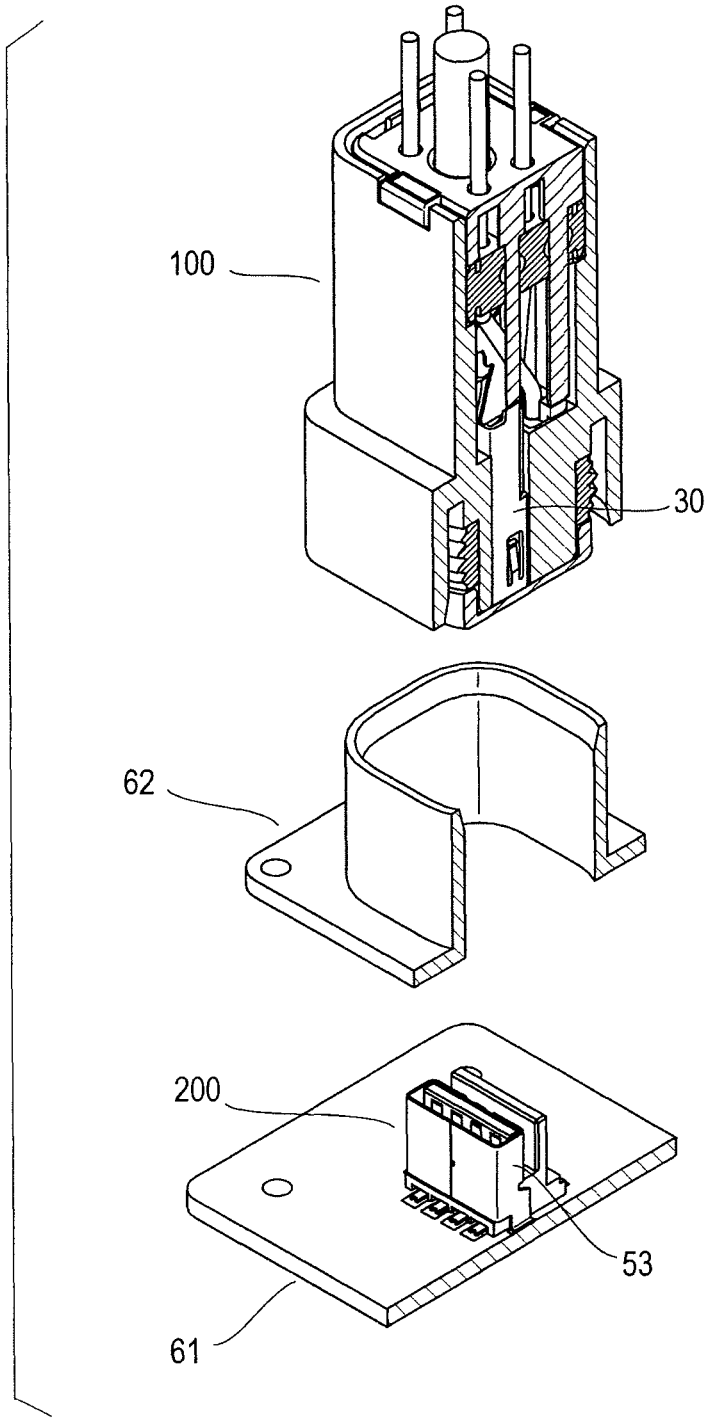
FIG. 12 is a sectional perspective view of the structure of the connector according to the first embodiment of the present invention.

FIG. 12 is a sectional view showing the positional relationship between the shield shell 30 housed in the cable connector 100 and the shield shell 53 of the board connector 200, with the housing 62 and the shield shell 30 exposed.

In this embodiment, the contacts 26 of the cable connector 100 connected to the core wires 41*b* of the shielded cable 41 are surrounded and properly shielded by the shield shell 30, and the board contacts 52 of the board connector 200 connected to the contacts 26 surrounded by the shield shell 30 are also surrounded and properly shielded by the shield shell 53.

Second and third embodiments will be described next. Elements identical to elements in the first embodiment will be indicated by identical reference symbols, and a detailed description of those elements will be omitted.

Second Embodiment

In the first embodiment, the housing 62 is attached to the board 61 on which the board connector 200 is mounted. In the second embodiment, the housing is attached to a case accommodating the board.

Figure 13A:
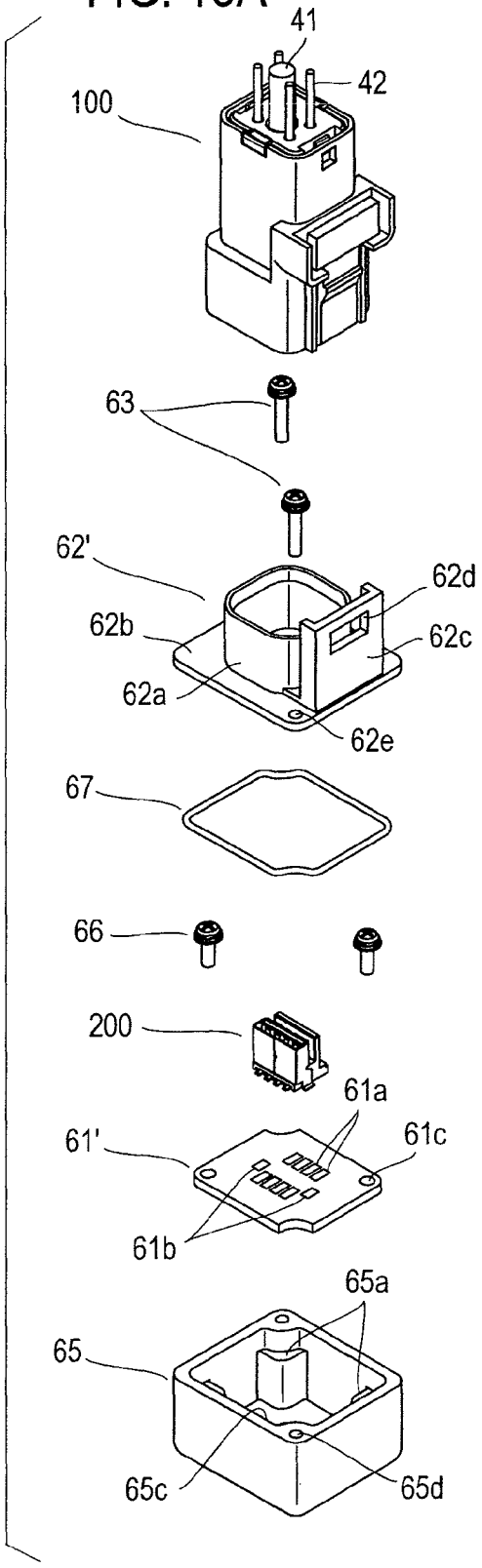
FIG. 13A is an exploded perspective view of the structure of a connector according to a second embodiment of the present invention, viewed obliquely from above.
Figure 13B:
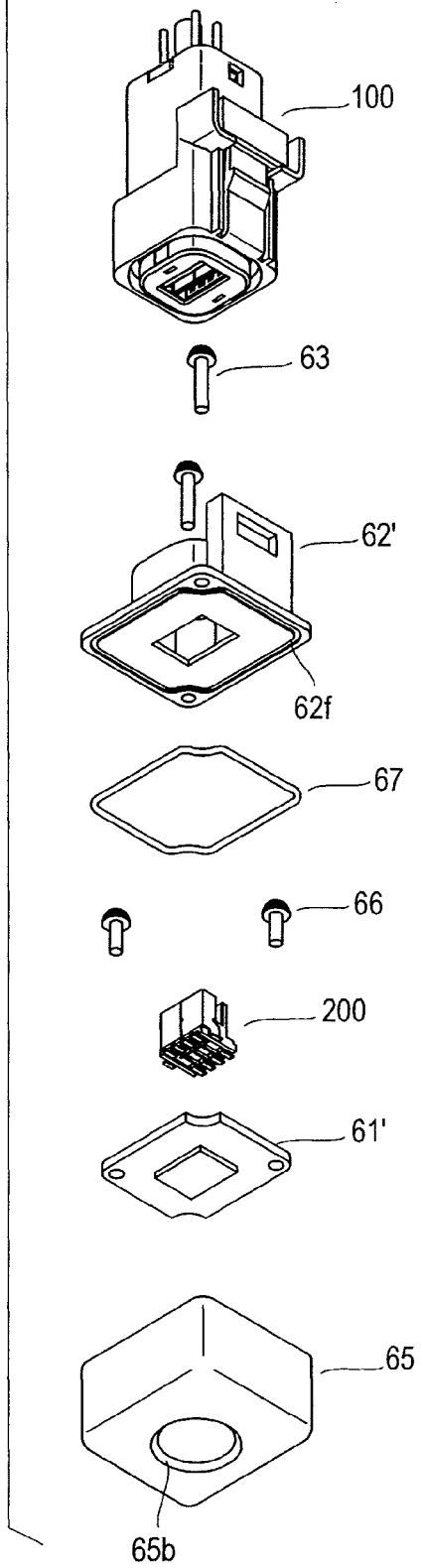
FIG. 13B is an exploded perspective view of the structure of the connector according to the second embodiment of the present invention, viewed obliquely from below.

FIGS. 13A and 13B show the structure of the second embodiment. In FIGS. 13A and 13B, reference numeral 65 denotes a case accommodating a board 61'. The other parts disposed in the case 65 are not shown in the figure. The case 65 is the case of a camera, for example. The case 65 has a rectangular parallelepiped shape and has stage parts 65*a* formed in the four inner corners. The top of the case 65 is open. The case 65 has a circular window 65*b* formed in the bottom for a lens to be disposed inside.

The board connector 200 is surface-mounted on the board 61' by reflow soldering, and the board 61' with the board connector 200 mounted thereon is mounted to the case 65. The board 61' is secured with two screws 66. The two screws 66 are inserted into two holes formed in the board 61' and screwed into holes (hidden in FIG. 13A) formed in a pair of opposing stage parts 65*a* of the case 65 to secure the board 61' to the case 65.

A housing 62' is attached to the case 65 to close the top opening 65*c* of the case 65. The housing 62' is secured with two screws 63. The two screws 63 are inserted into two holes 62*e* formed in the flange 62*b* of the housing 62' and are screwed into holes 65*d* formed in the top face of the case 65. Then, the housing 62' is secured to the case 65. An O ring 67 is placed between the top face of the case 65 and the flange 62*b* of the housing 62'. The flange 62*b* has a groove 62*f* on its bottom for positioning the O ring 67.

Figure 14B:
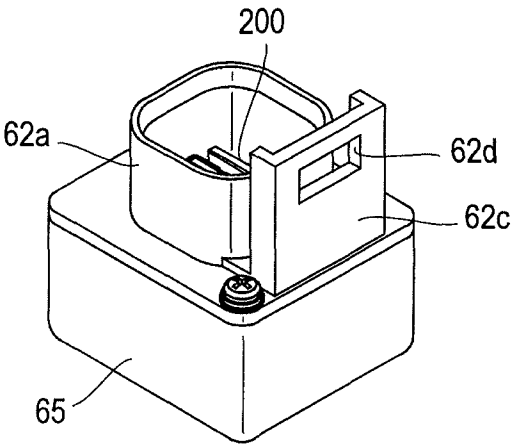
FIG. 14B is a perspective view of the case shown in FIG. 13A with the board, the board connector, and the housing mounted on it.
Figure 14A:
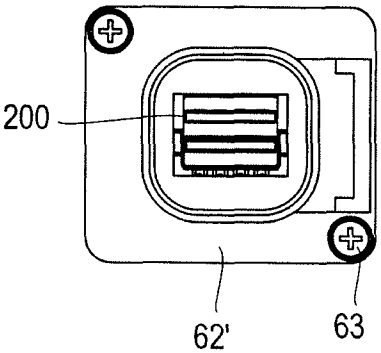
FIG. 14A is a plan view of a case shown in FIG. 13A with a board, a board connector, and a housing mounted on it.

FIGS. 14A and 14B show that the board 61' on which the board connector 200 is mounted and the housing 62' are attached to the case 65. In this embodiment, the housing 62' guides the cable connector 100 to the board connector 200, prevents the cable connector 100 from falling out, and also closes the case 65.

Figure 15B:
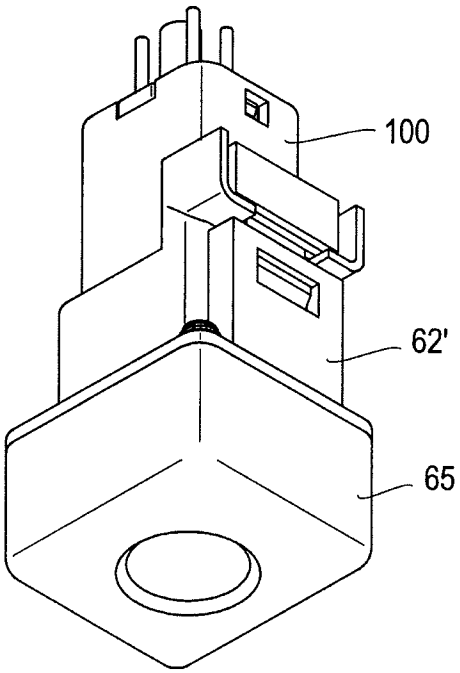
FIG. 15B is a perspective view of the connected state of the connector according to the second embodiment of the present invention, viewed obliquely from below.
Figure 15A:
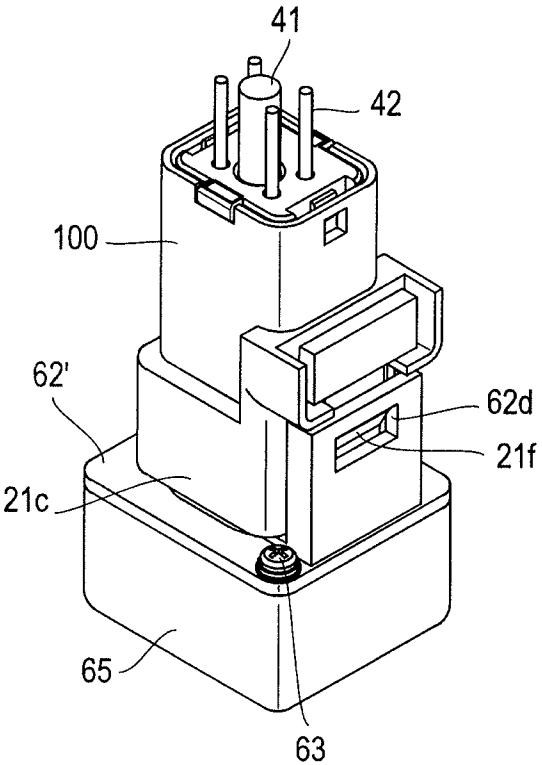
FIG. 15A is a perspective view of a connected state of the connector according to the second embodiment of the present invention, viewed obliquely from above.
Figure 16:
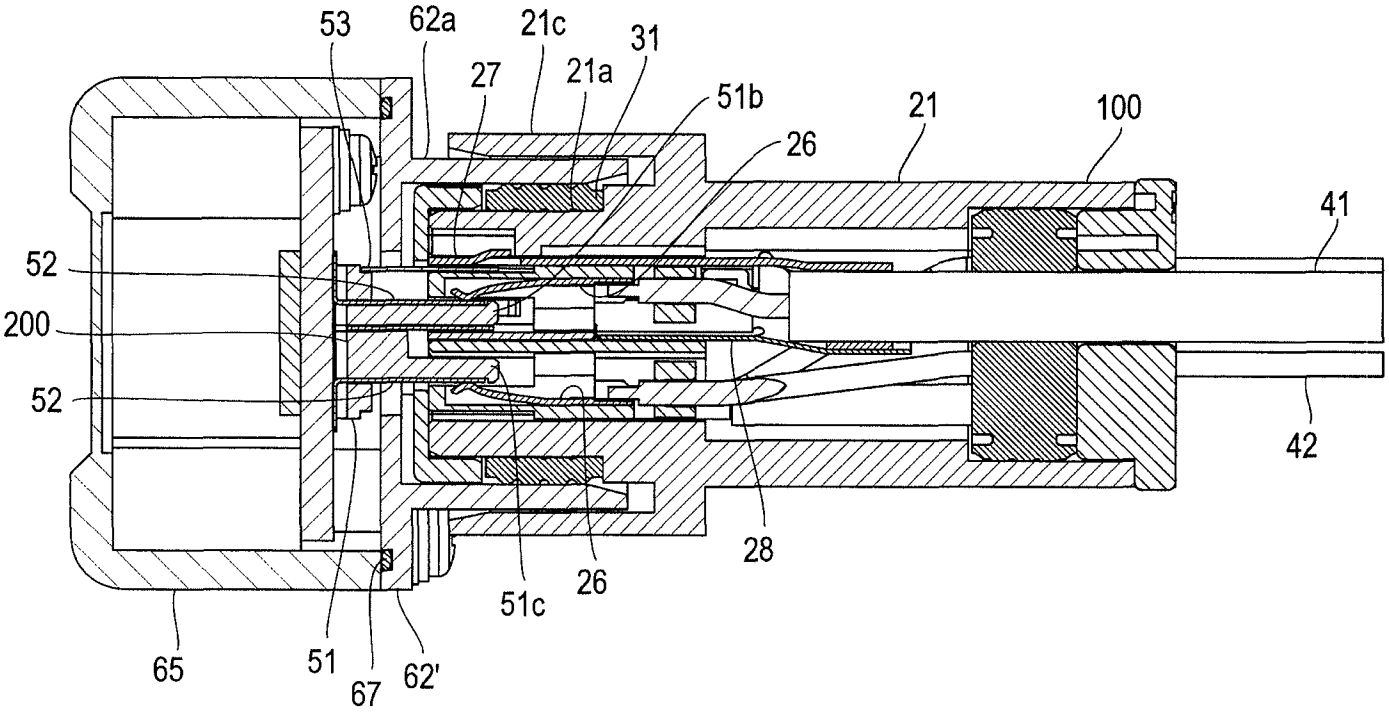
FIG. 16 is a sectional view of the connected state of the connector shown in FIG. 15A.
Figure 17:
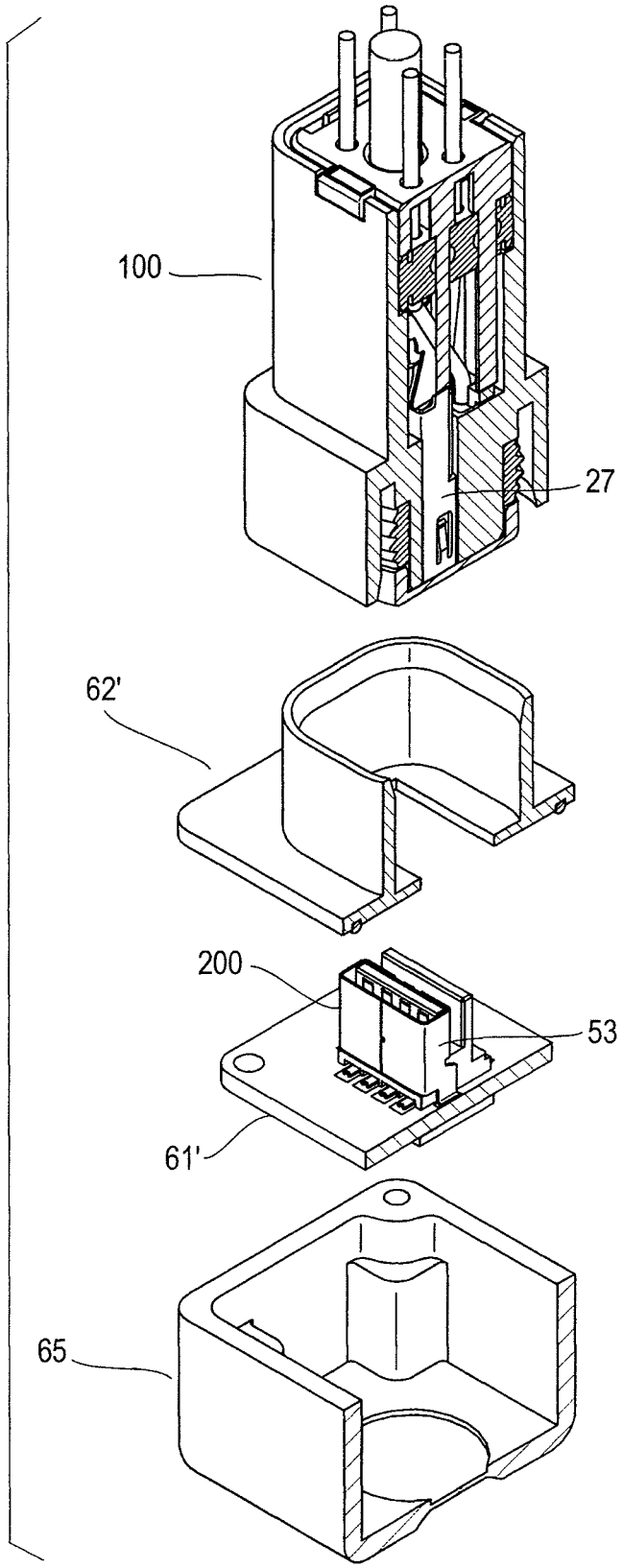
FIG. 17 is a sectional perspective view of the structure of the connector according to the second embodiment of the present invention.
Figure 18A:
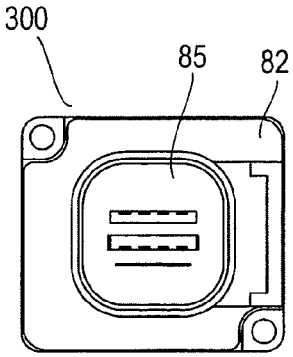
FIG. 18A is a plan view of a relay connector of a connector according to a third embodiment of the present invention.
Figure 18B:
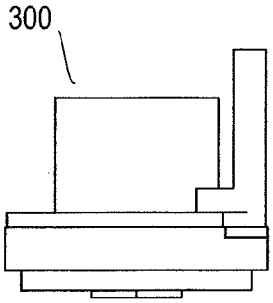
FIG. 18B is a front view of the relay connector shown in FIG. 18A.
Figure 18C:
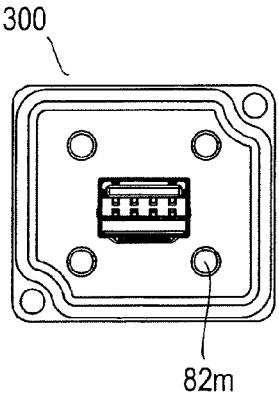
FIG. 18C is a bottom view of the relay connector shown in FIG. 18A.
Figure 18D:
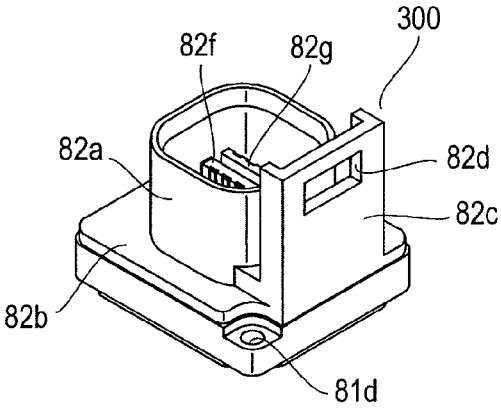
FIG. 18D is a perspective view of the relay connector shown in FIG. 18A.
Figure 18E:
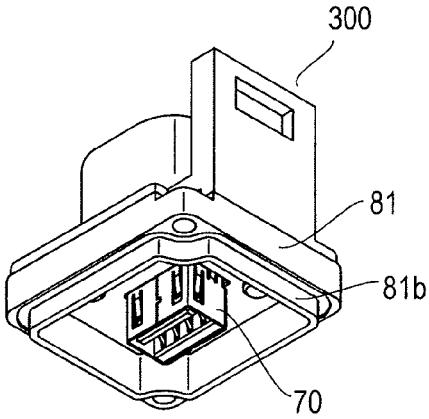
FIG. 18E is a perspective view of the relay connector shown in FIG. 18A.

FIGS. 15A and 15B show the cable connector 100 connected to the board connector 200 mounted as shown in FIGS. 14A and 14B in the same manner as in the first embodiment. FIG. 16 is a sectional view of the connected state. FIG. 17 shows the same kind of sectional view as shown in FIG. 12 in the first embodiment. The other parts disposed in the case 65 are not shown in FIG. 16 either.

The cable connector 100 and the board connector 200 in this embodiment are the same as in the first embodiment, and the contacts 26 of the cable connector 100 connected to the core wires 41*b* of the shielded cable 41 and the board contacts 52 of the board connector 200 are properly shielded. The inside of the case 65 is provided with a waterproofing structure in this embodiment, in a state in which the cable connector 100 is connected to the board connector 200 as shown in FIGS. 15A, 15B, and 16; this state will be described below.

The back end of the cable connector 100 from which the shielded cable 41 and the non-shielded cable 42 are drawn is waterproofed by the grommet 33 as described earlier. The O ring 67 is held between the case 65 and the housing 62' for waterproofing. In addition, since the rubber seal 31 is also attached around the insertion joint 21*a* of the cable connector 100, when the insertion joint 21*a* is inserted into and coupled to the tubular part 62*a* of the housing 62', the rubber seal 31 is held between the tubular part 62*a* and the insertion joint 21*a* and provides waterproofing to that portion. Accordingly, when the cable connector 100 is connected to the board connector 200, the case 65 prevents liquid from entering.

Third Embodiment

Figure 19:
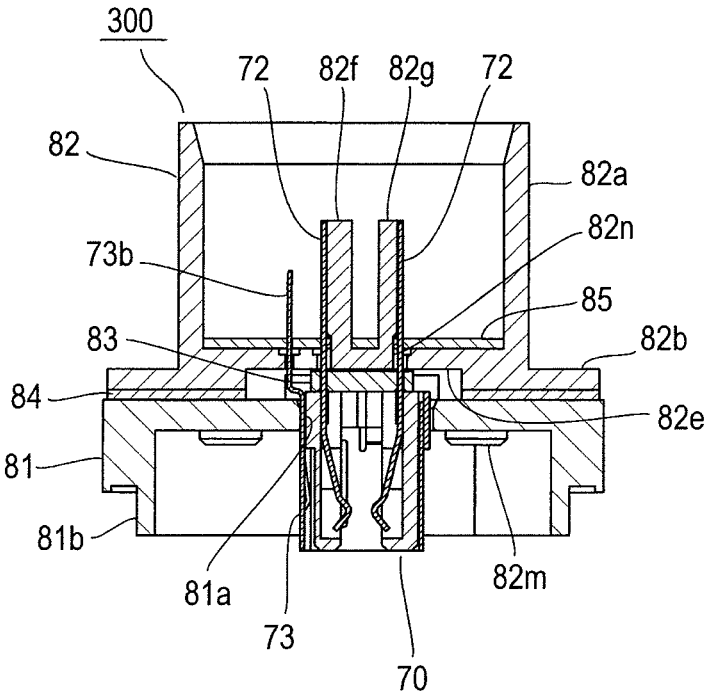
FIG. 19 is a sectional view of the relay connector shown in FIG. 18A.
Figure 20A:
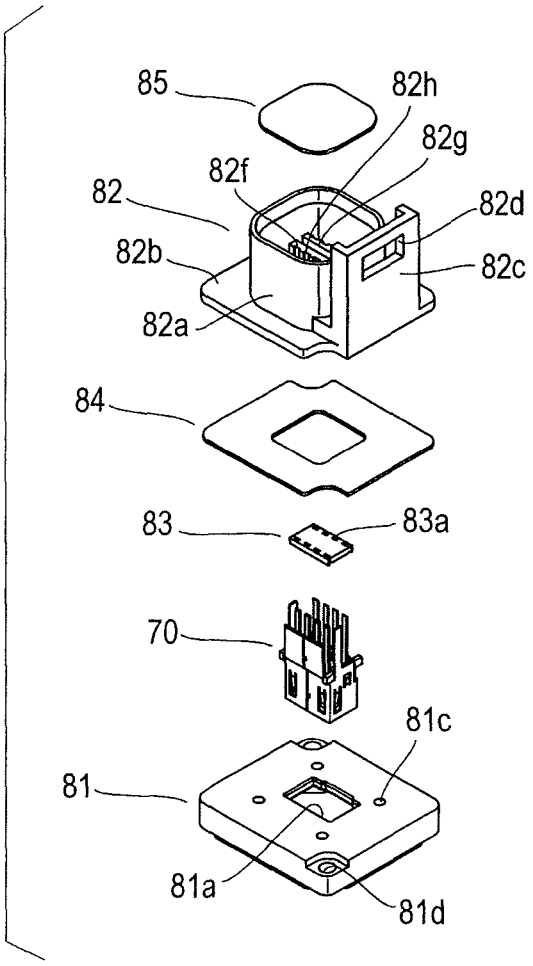
FIG. 20A is an exploded perspective view of the relay connector shown in FIG. 18A, viewed obliquely from above.
Figure 20B:
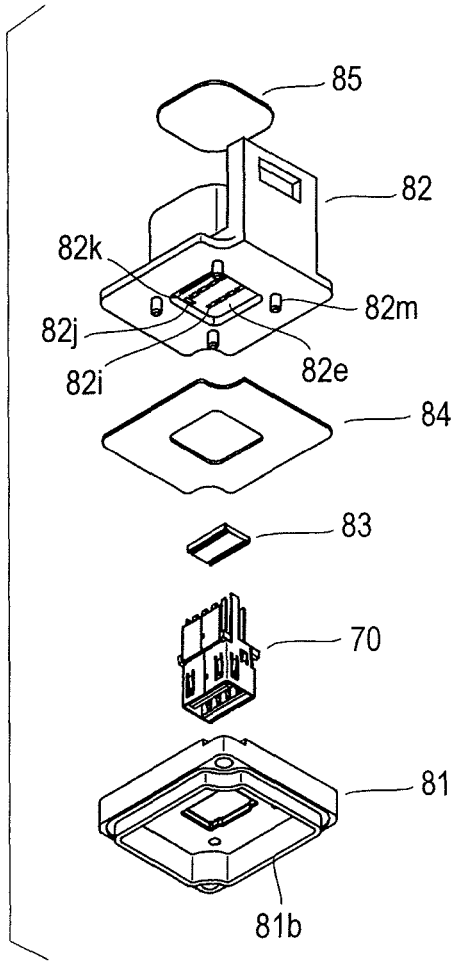
FIG. 20B is an exploded perspective view of the relay connector shown in FIG. 18A, viewed obliquely from below.
Figure 21C:
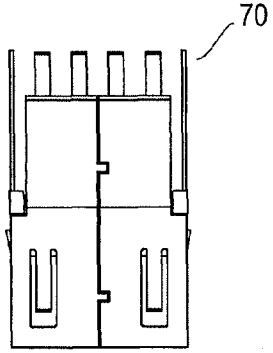
FIG. 21C is a rear view of the contact assembly shown in FIG. 21A.
Figure 21B:
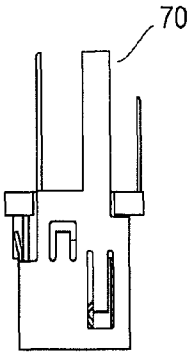
FIG. 21B is a side view of the contact assembly shown in FIG. 21A.
Figure 21A:
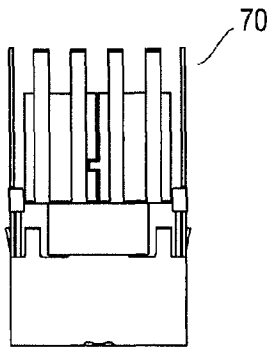
FIG. 21A is a front view of a contact assembly shown in FIG. 20A.
Figure 21E:
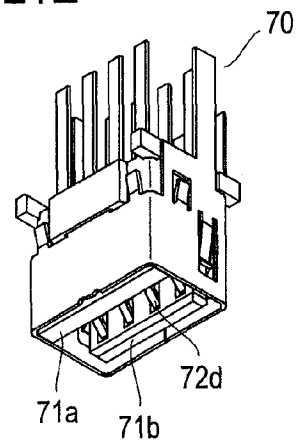
FIG. 21E is a perspective view of the contact assembly shown in FIG. 21A.
Figure 21D:
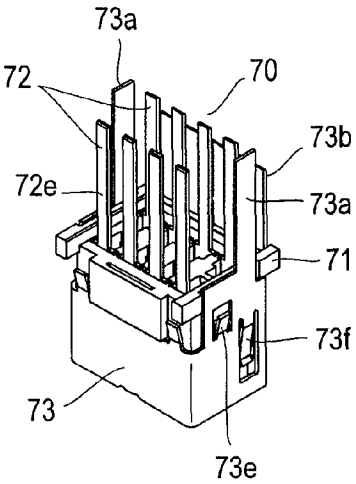
FIG. 21D is a perspective view of the contact assembly shown in FIG. 21A.

In a third embodiment, a cable connector and a board connector are connected through a relay connector. FIGS. 18A to 18E show the appearance of a relay connector 300, and FIG. 19 is a sectional view of the structure. FIGS. 20A and 20B are exploded views of the relay connector 300.

As shown in FIGS. 20A and 20B, the relay connector 300 includes a contact assembly 70, a rear case 81, a housing 82, an insulating plate 83, an adhesive 84, and a resin sealant 85. The adhesive 84 and the resin sealant 85 are schematically shown as elements in FIGS. 20A and 20B.

Figure 22B:
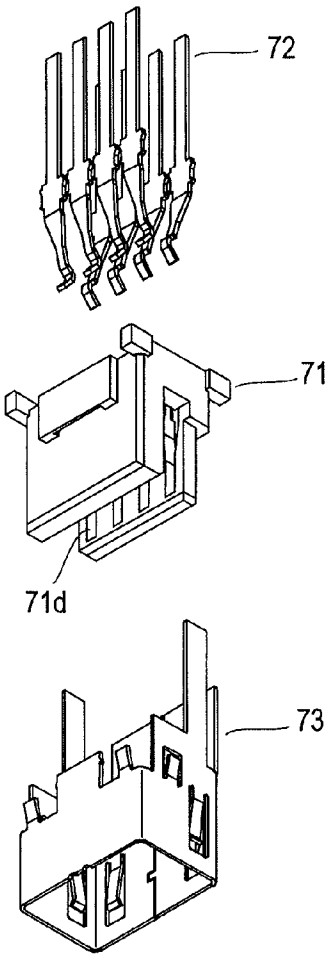
FIG. 22B is an exploded perspective view of the contact assembly shown in FIG. 21A, viewed obliquely from below.
Figure 22A:
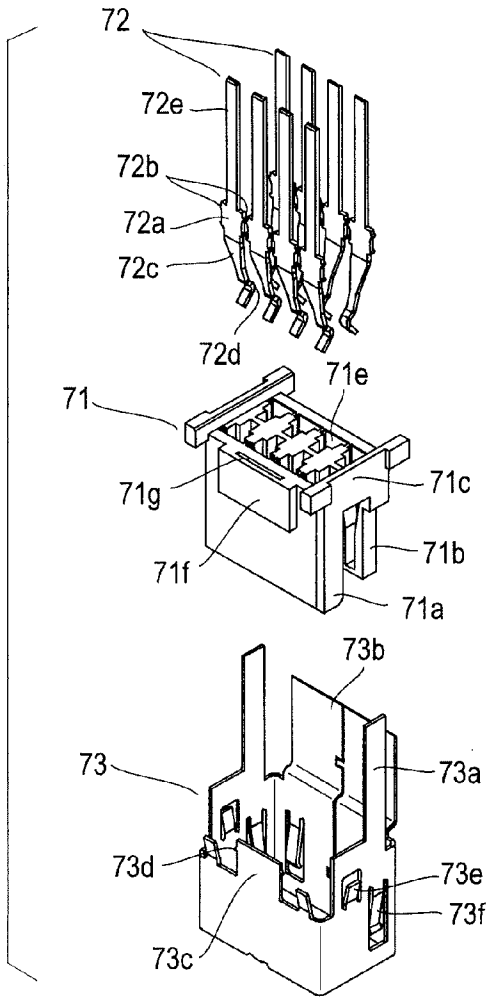
FIG. 22A is an exploded perspective view of the contact assembly shown in FIG. 21A, viewed obliquely from above.
Figure 23A:
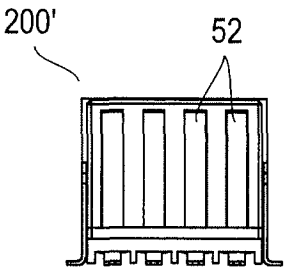
FIG. 23A is a front view of a board connector in the connector according to the third embodiment of the present invention.
Figure 23B:
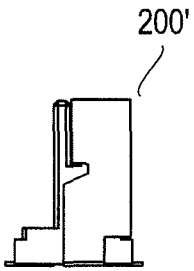
FIG. 23B is a side view of the board connector shown in FIG. 23A.
Figure 23C:
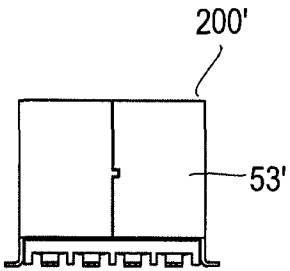
FIG. 23C is a rear view of the board connector shown in FIG. 23A.
Figure 23D:
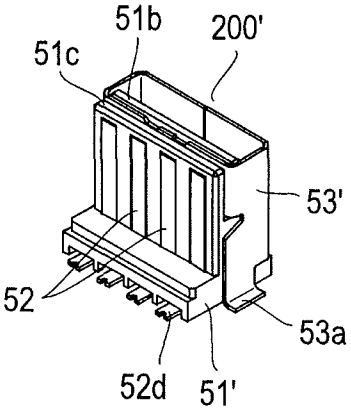
FIG. 23D is a perspective view of the board connector shown in FIG. 23A.
Figure 23E:
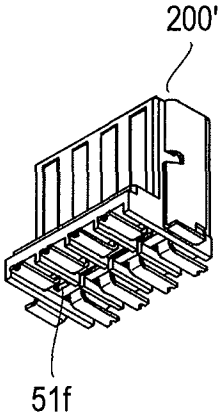
FIG. 23E is a perspective view of the board connector shown in FIG. 23A.
Figure 23F:
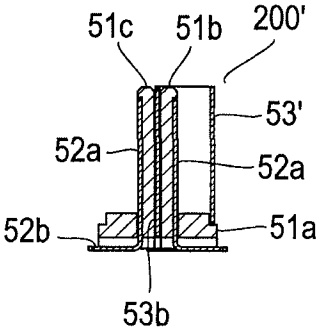
FIG. 23F is a sectional view of the board connector shown in FIG. 23A.

FIGS. 21A to 21E show details of the contact assembly 70 shown in FIGS. 20A and 20B. FIGS. 22A and 22B are exploded views of the contact assembly 70. The contact assembly 70 includes a body 71, relay contacts 72, and a shield shell 73.

The body 71 is made of resin and holds the relay contacts 72 in line. The body 71 includes a pair of vertical plates 71*a* and 71*b*, and their top ends are connected by a coupling member 71*c*. The vertical plates 71*a* and 71*b* respectively have four grooves 71*d* formed on their mutually opposing inner faces. The coupling member 71*c* has eight through holes 71*e* connected to the respective grooves 71*d*.

The relay contacts 72 are made of strip-shaped metal plates. A press-fitting part 72*a* in the middle in the longitudinal direction of each relay contact 72 has projections 72*b* to be press-fitted on both sides in the width direction. The relay contact 72 is bent and raised at one side of the press-fitting part 72*a* to make a movable section 72*c*, and a contact portion 72*d* is folded back at the tip of the movable section 72*c*.

Each relay contact 72 is attached to the body 71 by press-fitting the press-fitting part 72*a* into the hole 71*e* in the body 71, and the movable section 72*c* is placed in the groove 71*d*. A total of eight relay contacts 72 are attached to the body 71. An extended part 72*e* at the opposing end of the relay contact 72 sticks out from the body 71.

The shield shell 73 is formed by bending a metal plate and has a rectangular tube shape surrounding the body 71. Extended parts 73*a* extend upward from the opposing short sides of one end (upper end) of the shield shell 73, and an extended part 73*b* extends upward from one long side. On the other long side, a narrowed part 73*c* has projections 73*d* to be press-fitted on both sides in the width direction.

The shield shell 73 is secured to the body 71 by press-fitting the narrowed part 73*c* into a slit 71*g* formed in a projection portion 71*f* projecting from the outer face of the vertical plate 71*a* of the body 71. Like the extended parts 72*e* of the relay contacts 72, the extended parts 73*a* and 73*b* of the shield shell 73 stick out from the body 71. The contact assembly 70 is formed by press-fitting the eight relay contacts 72 and the shield shell 73 into the body 71.

The rear case 81 is made of metal, such as aluminum. The rear case 81 has a rectangular plate shape with a rectangular opening 81*a* formed at the center. A projection 81*b* is formed on the whole rim of the lower face, having a shape corresponding to the inner walls of the opening 65*c* of the case 65 in the second embodiment, described earlier.

The contact assembly 70 is press-fitted into the rectangular opening 81*a* of the rear case 81 from above. The shield shell 73 of the contact assembly 70 has fixing catches 73*e*. The shield shell 73 and the rear case 81 are secured to each other and are electrically connected by the catches 73*e*.

The insulating plate 83 has eight slits 83*a* corresponding to the eight relay contacts 72. The insulating plate 83 is mounted on the body 71 of the contact assembly 70 by passing the extended parts 72*e* of the relay contacts 72 through the slits 83*a*.

The housing 82 is similar to the housing 62 in the first embodiment in structure and includes a tubular part 82*a*, a flange 82*b*, and a side wall 82*c*. A window 82*d* is formed in the upper part of the side wall 82*c*. The lower end of the tubular part 82*a* is closed by a closing plate 82*e*, and a pair of vertical plates 82*f* and 82*g* stick out from the closing plate 82*e*.

Grooves 82*h* are formed on the outer faces of the vertical plates 82*f* and 82*g* in a direction parallel to the direction in which the vertical plates 82*f* and 82*g* stick out. Four grooves 82*h* are formed respectively on the vertical plates 82*f* and 82*g*. Slits 82*i* are formed on the closing plate 82*e* in line with the grooves 82*h*. The relay contacts 72 of the contact assembly 70 are inserted into the slits 82*i*. The closing plate 82*e* also has slits 82*j* and 82*k* into which the pair of extended parts 73*a* and the wide extended part 73*b* of the shield shell 73 of the contact assembly 70 are inserted.

The housing 82 structured as described above is bonded to the rear case 81 by the adhesive 84. Four bosses 82*m* projecting from the lower face of the flange 82*b* are inserted into through holes 81*c* formed in the rear case 81, and the ends are heat-caulked. The extended parts 72*e* of the eight relay contacts 72 of the contact assembly 70 pass through the slits 82*i*, project from the upper face of the closing plate 82*e* (inner bottom of the tubular part 82*a*), and reach the grooves 82*h* of the vertical plates 82*f* and 82*g* of the housing 82. The extended parts 73*a* and 73*b* of the shield shell 73 pass through the slits 82*j* and 82*k* and project from the inner bottom of the tubular part 82*a* of the housing 82.

The inside of the tubular part 82*a* is filled with resin, and the inner bottom of the tubular part 82*a* is sealed with the resin sealant 85. The relay connector 300 has the structure as described above. Engraved parts 82*n* are provided as shown in FIG. 19 at the bases of the vertical plates 82*f* and 82*g* in the areas where the relay contacts 72 are placed in order to improve the flow of the resin sealant 85 and to provide a proper waterproofing structure. The insulating plate 83 closes this area.

Figure 24B:
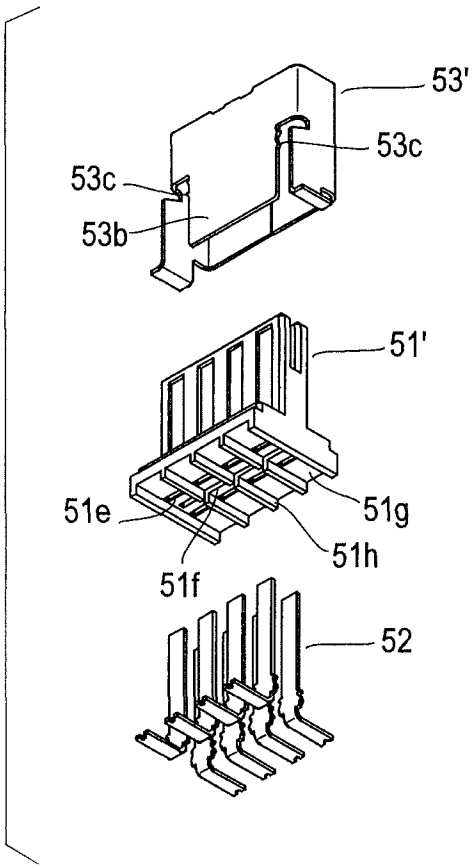
FIG. 24B is an exploded perspective view of the board connector shown in FIG. 23A, viewed obliquely from below.
Figure 24A:
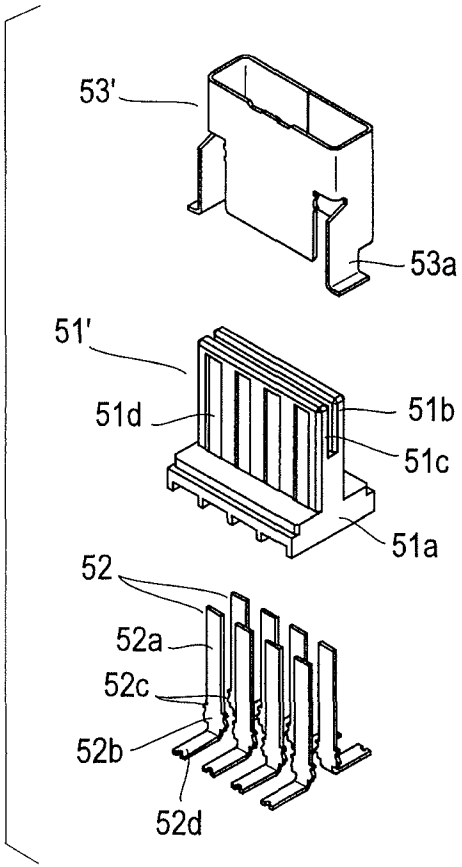
FIG. 24A is an exploded perspective view of the board connector shown in FIG. 23A, viewed obliquely from above.

FIGS. 23A to 23F show the appearance of a board connector 200' and a sectional view of its structure. FIGS. 24A and 24B are exploded views of the board connector 200'. Like the board connector 200 in the first embodiment, the board connector 200' includes a body 51', eight board contacts 52, and a shield shell 53'. The space between the pair of vertical plates 51*b* and 51*c* of the body 51' is narrower than the space between the pair of vertical plates 51*b* and 51*c* of the body 51 in the first embodiment, and the length of the short side of the rectangular tube shape of the shield shell 53' is smaller than that of the shield shell 53 in the first embodiment.

Figure 25A:
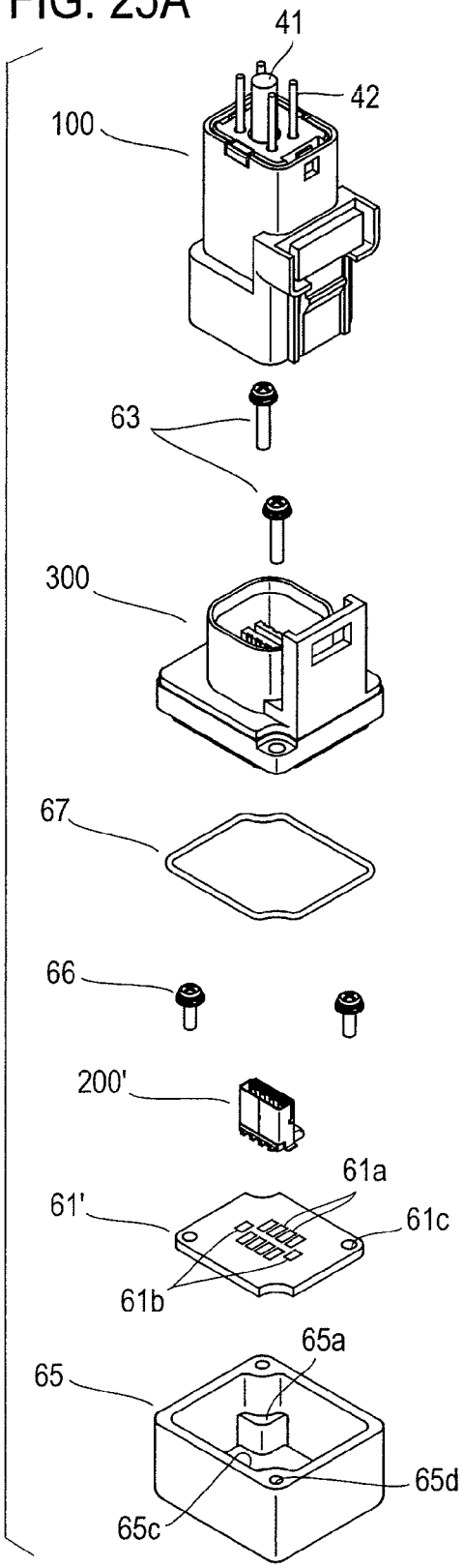
FIG. 25A is an exploded perspective view of the structure of the connector according to the third embodiment of the present invention, viewed obliquely from above.
Figure 25B:
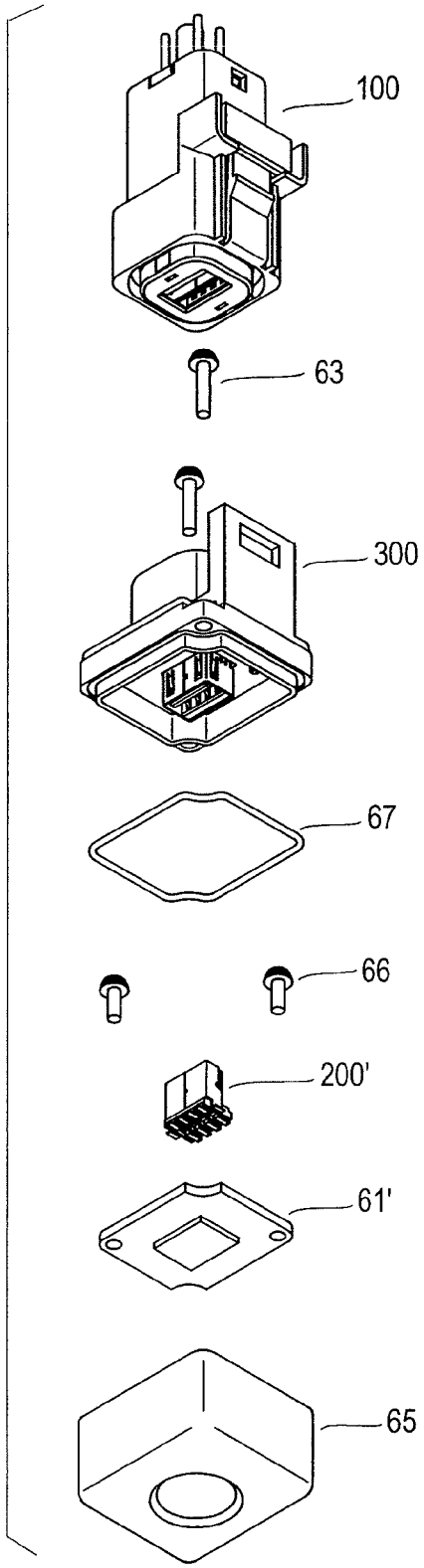
FIG. 25B is an exploded perspective view of the structure of the connector according to the third embodiment of the present invention, viewed obliquely from below.

FIGS. 25A and 25B show the overall structure of the third embodiment. The board 61', onto which the board connector 200' is surface-mounted by reflow soldering, is secured to the case 65 by the screws 66, as in the second embodiment. The projection 81*b* on the lower face of the rear case 81 is inserted into the opening 65*c* of the case 65, and the relay connector 300 is mounted to the case 65 to close the opening 65*c*. The relay connector 300 is secured by using the two screws 63. The two screws 63 are inserted into the two holes 81*d* formed in the rear case 81 and are screwed into the holes 65*d* of the case 65 to secure the relay connector 300 onto the case 65. The O ring 67 is disposed around the projection 81*b* on the lower face of the rear case 81, and the O ring 67 is held between the upper face of the case 65 and the rear case 81.

By mounting the relay connector 300 as described above, the pair of vertical plates 51*b* and 51*c* and the shield shell 53' of the board connector 200' are inserted into the shield shell 73 of the contact assembly 70 of the relay connector 300. The board contacts 52 come into contact with the relay contacts 72, respectively, thus connecting the eight board contacts 52 and the eight relay contacts 72. The shield shell 53' of the board connector 200' and the shield shell 73 of the relay connector 300 are electrically connected by the contact pieces 73*f* cut and raised in the shield shell 73 held in contact with the shield shell 53'.

The cable connector 100 is connected to the relay connector 300. The insertion joint 21*a* of the cable connector 100 is inserted into and coupled to the tubular part 82*a* of the housing 82 of the relay connector 300, and the projection 21*f* of the cable connector is caught by the window 82*d* of the housing 82. The housing 82 guides the cable connector 100 and also prevents it from falling out.

Figure 26B:
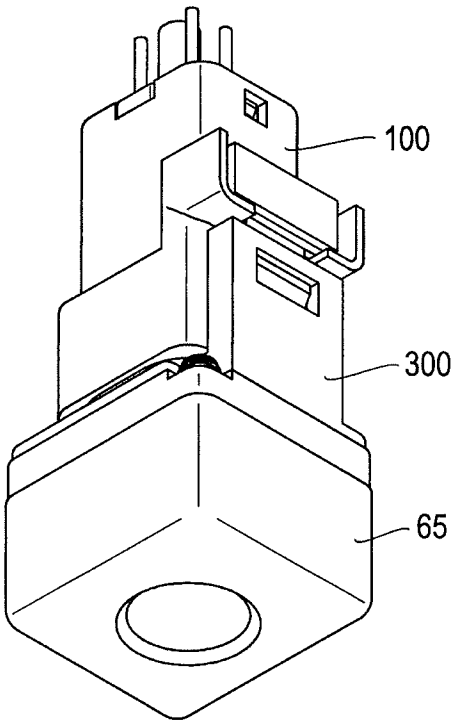
FIG. 26B is a perspective view of the connected state of the connector according to the third embodiment of the present invention, viewed obliquely from below.
Figure 26A:
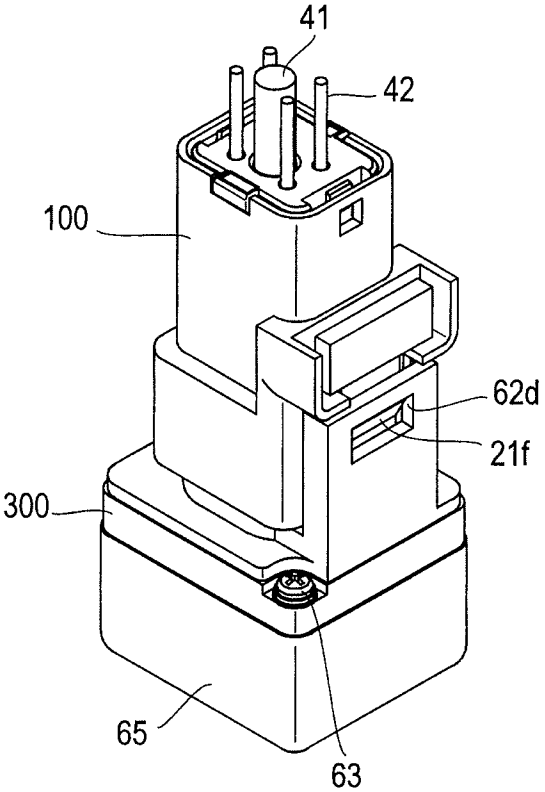
FIG. 26A is a perspective view of a connected state of the connector according to the third embodiment of the present invention, viewed obliquely from above.
Figure 27:
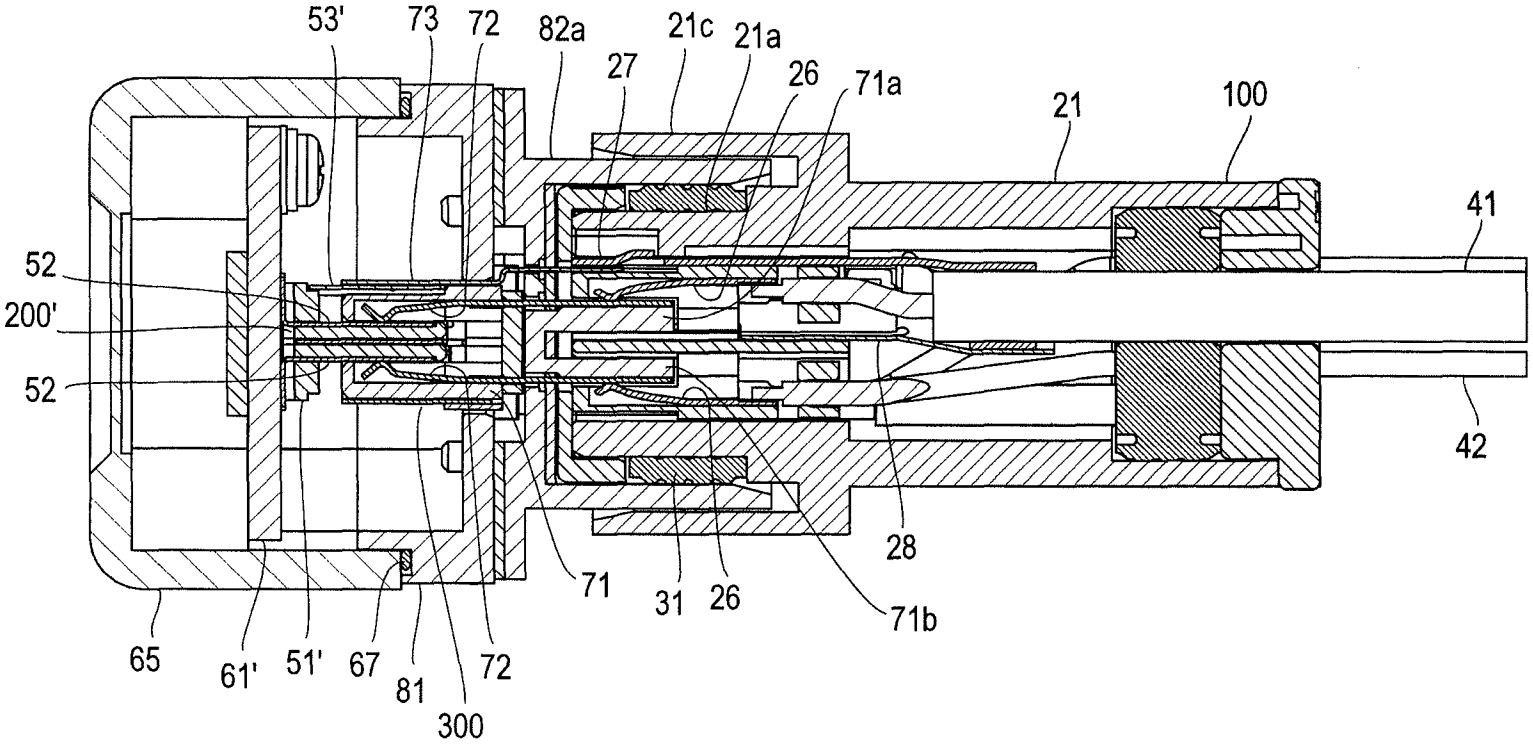
FIG. 27 is a sectional view of the connected state of the connector shown in FIG. 26A.
Figure 28:
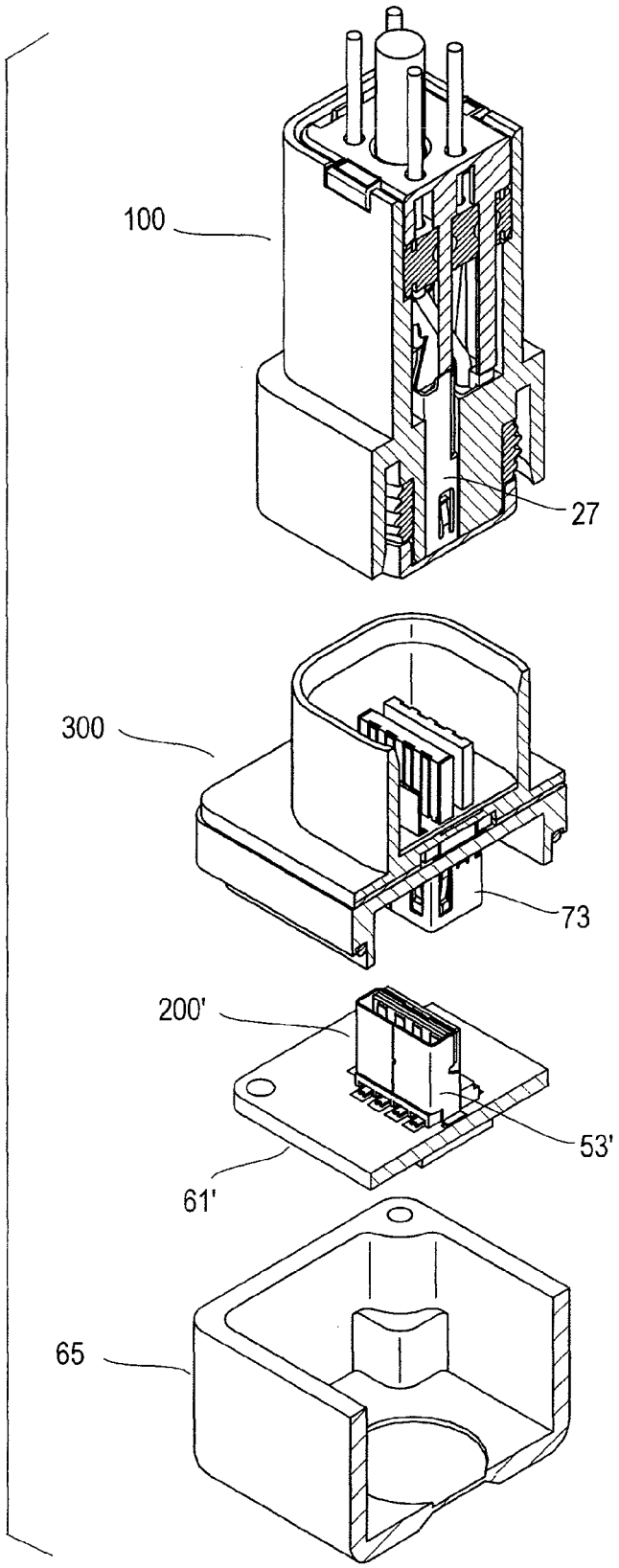
FIG. 28 is a sectional perspective view of the structure of the connector according to the third embodiment of the present invention.

FIGS. 26A and 26B show states in which the cable connector 100 is connected to the relay connector 300 as described above, and FIG. 27 is a sectional view of the connection. FIG. 28 is the same kind of sectional view as shown in FIG. 12 in the first embodiment.

By connecting the cable connector 100 to the relay connector 300, the vertical plates 82*f* and 82*g* of the housing 82 of the relay connector 300 are inserted into the insertion joint 21*a* of the cable connector 100. The contact portions 26*d* of the eight contacts 26 of the cable connector 100 come into contact with the relay contacts 72 arranged in the vertical plates 82*f* and 82*g*, respectively, thus connecting the eight contacts 26 of the cable connector 100 and the eight relay contacts 72 of the relay connector 300. The extended parts 73*a* and 73*b* of the shield shell 73 of the relay connector 300 are inserted into the shield shell 30 of the cable connector 100, and the contact pieces 27*d* disposed in the shell 27, constituting the shield shell 30, come into contact with and are electrically connected to the extended parts 73*a* and 73*b*.

In this embodiment, the cable connector 100 and the board connector 200' are connected through the relay connector 300. The contacts 26 of the cable connector 100 are connected to the board contacts 52 of the board connector 200' through the relay contacts 72 of the relay connector 300.

In this embodiment, the relay connector 300 is mounted to the case 65 to close the opening 65*c* of the case 65. Since the inner bottom face of the tubular part 82*a* of the housing 82 of the relay connector 300 is sealed by the resin sealant 85, a waterproofing structure is implemented in a state in which the relay connector 300 is mounted to the case 65, preventing liquid from entering the case 65.

The shield shell 73 of the relay connector 300 does not have a structure that surrounds only the relay contacts 72 connected to the contacts 26 of the cable connector 100 which are connected to the core wires 41*b* of the shielded cable 41. However, in a state in which the board connector 200', the relay connector 300, and the cable connector 100 are connected, the unsurrounded part is very small. When the connectors are connected, the impedance is substantially determined by the transfer path between the cable connector 100 and the board connector 200'.

In the embodiments described above, since the board connectors 200 and 200' are surface-mounted, they can be mounted to a board, for example, together with the other electronic components by reflow soldering, which facilitates assembly.

A connector according to the present invention has a shielded transfer path and a non-shielded transfer path and is favorable for sending a control signal and an image signal in a camera, for example, as described in one embodiment. By sending the image signal in the shielded transfer path and the control signal in the non-shielded transfer path, the image signal can be isolated from noise occurring from the control signal and can be sent properly at high speed. An inexpensive non-shielded cable (discrete wire) is used for the control signal, which does not need to be shielded.

What is claimed is:

1. A connector comprising:

a board connector mounted on a board; and a cable connector attached to ends of both a shielded cable and a non-shielded cable and connected to the board connector;

the cable connector comprising:

contacts connected respectively to core wires of the shielded cable and the non-shielded cable; and a cable shield shell surrounding only the contacts connected to the core wires of the shielded cable;

the board connector comprising:

board contacts connected respectively to the contacts of the cable connector; and a board shield shell surrounding only the board contacts connected to the contacts surrounded by the cable shield shell, so that the other board contacts connected to the contacts not surrounded by the cable shield shell are not surrounded by the board shield shell.

2. The connector according to claim 1, further comprising a housing mounted on the board, wherein the housing comprises:

a tubular part to which an insertion joint of the cable connector is coupled; and a window which catches a projection on the cable connector; and the housing guides the cable connector with respect to the board connector and prevents the cable connector from falling out.

3. The connector according to claim 1, further comprising a housing that is disposed at an opening of a case accommodating the board and that is mounted to the case, wherein the housing comprises:

a tubular part to which an insertion joint of the cable connector is coupled; and a window which catches a projection on the cable connector; and the housing guides the cable connector with respect to the board connector and prevents the cable connector from falling out.

4. The connector according to claim 1, wherein the cable connector and the board connector are connected through a relay connector.

5. The connector according to claim 4, wherein the relay connector comprises relay contacts, a rear case, and a housing;

the contacts and the board contacts are connected through the relay contacts;

the rear case is disposed at an opening of a case accommodating the board and is mounted to the case; and the housing comprises a tubular part to which the insertion joint of the cable connector is coupled and a window which catches a projection on the cable connector and is secured onto the rear case.

6. The connector according to claim 5, wherein the relay contacts project from the inner bottom of the tubular part, and the inner bottom of the tubular part is sealed with resin.

7. The connector according to claim 2, wherein waterproofing members are respectively attached to the back end of the cable connector from which the shielded cable and the non-shielded cable are led out and the circumference of the insertion joint.

8. The connector according to claim 3, wherein waterproofing members are respectively attached to the back end of the cable connector from which the shielded cable and the non-shielded cable are led out and the circumference of the insertion joint.

9. The connector according to claim 5, wherein waterproofing members are respectively attached to the back end of the cable connector from which the shielded cable and the non-shielded cable are led out and the circumference of the insertion joint.

10. The connector according to claim 6, wherein waterproofing members are respectively attached to the back end of the cable connector from which the shielded cable and the non-shielded cable are led out and the circumference of the insertion joint.

11. The connector according to one of claims 1 to 10, wherein the board connector is surface-mounted on the board.

12. A connector comprising:

a board connector mounted on a board; and a cable connector attached to ends of both a shielded cable and a non-shielded cable and connected to the board connector;

the cable connector comprising:

a contact connected to a core wire of the shielded cable;

a contact connected to a core wire of the non-shielded cable; and a cable shield shell which surrounds the contact connected to the core wire of the shielded cable and does not surround the contact connected to the core wire of the non-shielded cable;

the board connector comprising:

a first board contact connected to the contact that is connected to the core wire of the shielded cable;

a second board contact connected to the contact that is connected to the core wire of the non-shielded cable; and a board shield shell which surrounds the first board contact and does not surround the second board contact.

* * * * *